US007417527B2

(12) United States Patent
Yamashita

(10) Patent No.: US 7,417,527 B2
(45) Date of Patent: Aug. 26, 2008

(54) PTC ELEMENT

(75) Inventor: Yasuhide Yamashita, Tokyo (JP)

(73) Assignee: TDK Corporation, Tokyo (JP)

( * ) Notice: Subject to any disclaimer, the term of this patent is extended or adjusted under 35 U.S.C. 154(b) by 0 days.

(21) Appl. No.: 11/717,099

(22) Filed: Mar. 13, 2007

(65) Prior Publication Data

US 2007/0229213 A1 Oct. 4, 2007

(30) Foreign Application Priority Data

Mar. 28, 2006 (JP) ..... 2006-087912
Apr. 27, 2006 (JP) ..... 2006-124133
May 12, 2006 (JP) ..... 2006-134118

(51) Int. Cl.
*H01C 7/10* (2006.01)

(52) U.S. Cl. ..... 338/22 R; 252/511

(58) Field of Classification Search ..... 338/22 R, 338/328, 332; 252/511–512, 518–519
See application file for complete search history.

(56) References Cited

U.S. PATENT DOCUMENTS 5,210,517 A * 5/1993 Abe ..... 338/22 R
5,801,612 A * 9/1998 Chandler et al. ..... 338/22 R
6,090,313 A * 7/2000 Zhao ..... 252/500
6,512,446 B2 * 1/2003 Wang et al. ..... 338/22 R
6,531,950 B1 * 3/2003 Becker et al. ..... 338/22 R
6,620,343 B1 * 9/2003 Blok et al. ..... 252/511

FOREIGN PATENT DOCUMENTS

JP A 60-196901 10/1985
JP A-1-189153 7/1989
JP B2 5-9921 2/1993
JP A-10-208902 8/1998
JP A-2005-317781 11/2005

OTHER PUBLICATIONS

Notification of Reasons for Refusal, May 7, 2008, 3 pgs.

* cited by examiner

*Primary Examiner*—Kyung Lee
(74) *Attorney, Agent, or Firm*—Oliff & Berridge, PLC

(57) ABSTRACT

A PTC element has an element body in which an electroconductive filler is dispersed in a crystalline polymer, a pair of lead terminals compressed with the element body in between, and a protecting film covering a portion of the element body not compressed against the pair of lead terminals. Each of the pair of lead terminals has an overlap region overlapping with the element body, and a nonoverlap region not overlapping with the element body. An anchor projection embedded in the element body is formed in the overlap region of each of the pair of lead terminals. A peel prevention region for preventing peeling of the protecting film is formed in a region adjoining the element body in the nonoverlap region. The anchor projection is formed as crushed in a region except for at least the peel prevention region in the nonoverlap region.

14 Claims, 14 Drawing Sheets

PTC ELEMENT

BACKGROUND OF THE INVENTION

1. Field of the Invention

The present invention relates to a PTC (Positive Temperature Coefficient) element.

2. Related Background Art

A PTC element is known as an element for protecting a circuit element from overcurrent. The PTC element is an element that rapidly increases the positive temperature coefficient of resistance at a specific temperature region. One of such known PTC elements is the one described in Japanese Patent Application Laid-Open No. 60-196901 (Japanese Patent Publication No. 5-9921).

SUMMARY OF THE INVENTION

The PTC element described in the foregoing Laid-Open No. 60-196901 is constructed as follows: the element with a positive resistance temperature characteristic is comprised of a polymer and an electroconductive powder dispersed in the polymer, metal plates whose surfaces in contact with surfaces of the element are roughened are joined to the surfaces of the element, and the metal plates are used as terminal electrodes. The surfaces in contact with the surfaces of the element are roughened in order to improve the bond strength between the element and the metal plates.

However, in the case where the entire surfaces in contact with the surfaces of the element were roughened as in the PTC element described in the foregoing Laid-Open No. 60-196901, there was a risk of failure in ensuring sufficient bond strength if the metal plates serving as the terminal electrodes were joined to connection terminals such as external terminals by welding or by soldering.

An object of the present invention is therefore to provide a PTC element capable of achieving an improvement in bond strength on the occasion when lead terminals extending from an element body are joined to other terminals.

The Inventors also found the following new problem during the process of research on the PTC element that can solve the aforementioned problem. There is a possibility that oxygen enters the element body from surroundings, with passage of a predetermined time after production of the PTC element. For preventing oxygen from entering the element body, a conceivable solution is to provide the element body with such a protecting film as to cover it. However, this protecting film could peel off, and the Inventors came to find that some countermeasure was needed. The present invention has been accomplished from this standpoint.

A PTC element according to the present invention is a PTC element comprising: an element body in which an electroconductive filler is dispersed in a crystalline polymer; a pair of lead terminals compressed with the element body in between; and a protecting film covering a portion of the element body not compressed against the pair of lead terminals; wherein each of the pair of lead terminals has an overlap region overlapping with the element body, and a nonoverlap region not overlapping with the element body, wherein an anchor projection embedded in the element body is formed in the overlap region of each of the pair of lead terminals, wherein a peel prevention region for preventing peeling of the protecting film is formed in a region adjoining the element body in the nonoverlap region, and wherein the anchor projection is formed as crushed, in a region except for at least the peel prevention region in the nonoverlap region.

In the present invention, the anchor projection is formed as crushed, in the region except for at least the peel prevention region in the nonoverlap region. This results in substantially flattening the mentioned region and improves the bond strength in joining to other terminals. The peel prevention region is formed in the region adjoining the element body in the nonoverlap region. This prevents peeling of the protecting film covering the element body.

Preferably, the peel prevention region is formed in a region where the pair of lead terminals overlap each other. Since the peel prevention region is formed in the region where the lead terminals overlap each other, the protecting film is sandwiched between the lead terminals, whereby peeling of the protecting film is prevented more reliably.

Preferably, the anchor projection embedded in the protecting film is formed in the peel prevention region. Since the anchor projection is formed in the peel prevention region, peeling of the protecting film can be prevented more effectively.

Preferably, the peel prevention region is a roughened region a surface of which is roughened. Since the surface is roughened in the roughened region, the surface area is substantially increased. For this reason, the area of contact between the protecting film and the lead terminals is effectively increased, whereby the peel strength of the protecting film can be more improved.

Preferably, the surface of the roughened region is roughened by etching. Etching enables easier roughening of the surfaces of the lead terminals than mechanical methods such as grinding. For this reason, the roughened region can be readily formed.

Preferably, at least one of a through hole and a notch is formed in the peel prevention region, and the protecting film is formed through the at least one of the through hole and the notch to an opposing surface of the lead terminal. Since at least one of the through hole and the notch is formed in the peel prevention region and the protecting film penetrates through the at least one of the through hole and the notch to the other side to form an anchor shape, it is feasible to prevent peeling of the protecting film covering the element body.

Preferably, the at least one of the through hole and the notch is formed in a region where the pair of lead terminals overlap each other. Since at least one of the through hole and the notch is formed in the region where the lead terminals overlap each other, the protecting film is sandwiched between the lead terminals, whereby peeling of the protecting film can be prevented more reliably. It is also feasible to let out air left in the protecting film disposed on the element body and around the nonoverlap regions adjoining the element body, through the at least one of the through hole and the notch. Therefore, when the protecting film is filled in a portion of recessed shape, a coating can also be made without trapping air.

Preferably, the at least one of the through hole and the notch is formed in a region where the nonoverlap regions on both sides of the overlap region overlap each other. Since at least one of the through hole and the notch is formed in the mutually overlapping region on both sides of the element body, peeling of the protecting film can be further prevented.

The present invention enables the improvement in bond strength in joining the lead terminals extending from the element body, to other terminals and prevents peeling of the protecting film covering the element body. Therefore, the invention prevents oxygen from contacting the element body and oxidizing the element body.

The present invention will become more fully understood from the detailed description given hereinbelow and the accompanying drawings which are given by way of illustration only, and thus are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DESCRIPTION OF THE PREFERRED EMBODIMENTS

The expertise of the present invention can be readily understood in view of the following detailed description with reference to the accompanying drawings presented by way of illustration only. Subsequently, embodiments of the present invention will be described with reference to the accompanying drawings. The same portions will be denoted by the same reference symbols as much as possible, without redundant description.

Figure 1:
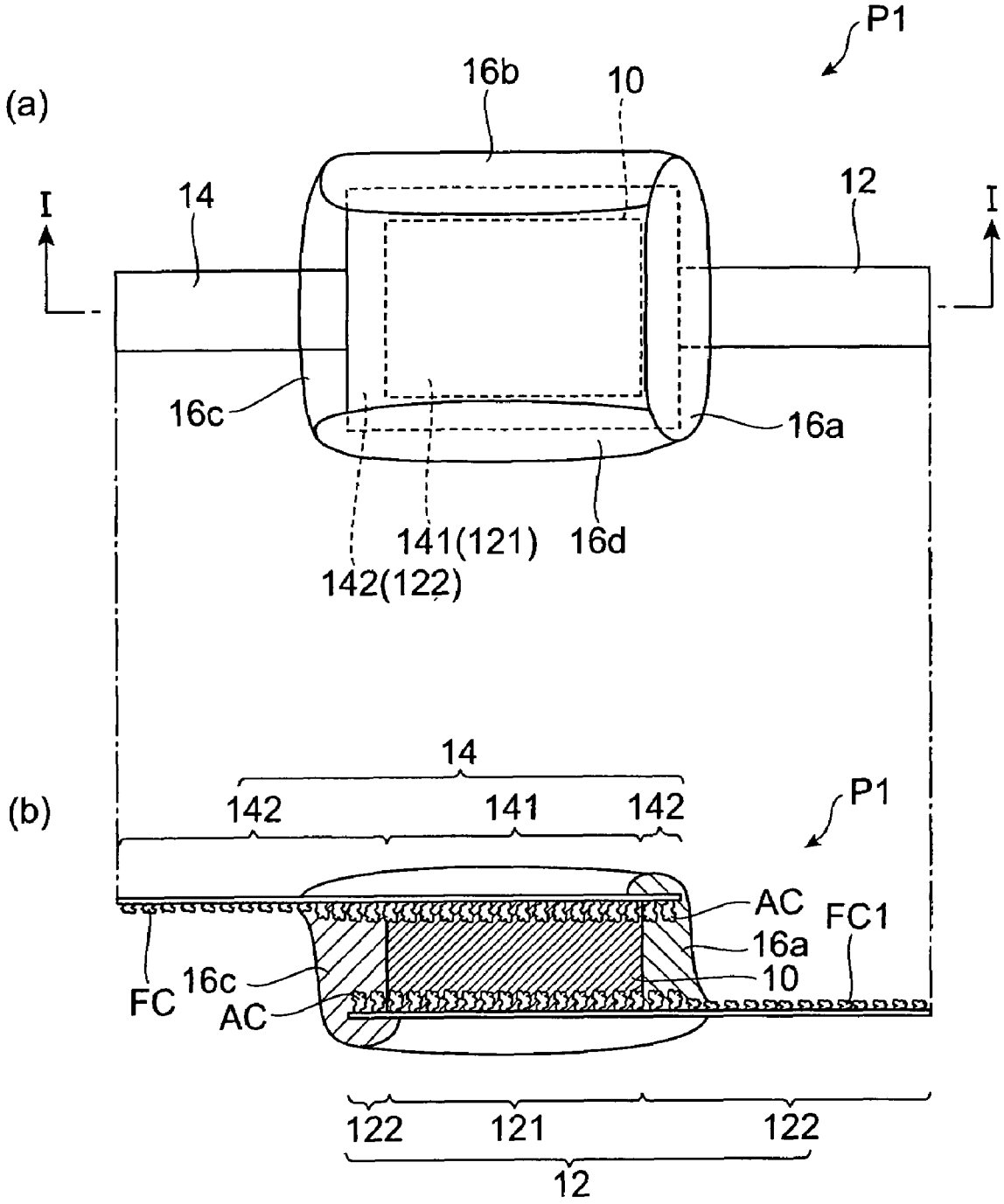
FIG. 1 is a plan view and sectional view showing a PTC element in the first embodiment.

The PTC element as the first embodiment of the present invention will be described with reference to FIG. 1. Part (a) of FIG. 1 is a plan view of the PTC element P1 and part (b) of FIG. 1 a sectional view near the center of the PTC element P1 (along I-I in (a) of FIG. 1). The PTC element P1 is a polymer PTC element and comprises a pair of terminal electrodes 12, 14 (lead terminals), an element body 10, and protecting films 16*a*, 16*b*, 16*c*, 16*d*.

The pair of terminal electrodes 12, 14 are formed in the thickness of about 0.1 mm and of Ni or Ni alloy. The pair of terminal electrodes 12, 14 are arranged so as to be opposed in part to each other. Since the element body 10 is located between the opposed portions of the pair of terminal electrodes 12, 14, the element body 10 is sandwiched between the facing surfaces of the respective terminal electrodes 12, 14. Therefore, each of the pair of terminal electrodes 12, 14 is composed of an overlap region 121, 141 overlapping with the element body 10, and a nonoverlap region 122, 142 not overlapping with the element body 10.

The element body 10 is formed so as to be smaller than the mutually overlapping portions of the terminal electrode 12 and the terminal electrode 14. Therefore, the nonoverlap regions 122, 142 are formed around the element body 10 so that they do not overlap with the element body 10, while the terminal electrode 12 and the terminal electrode 14 overlap each other.

The element body 10 is formed by dispersing an electroconductive filler in a crystalline polymer resin. The electroconductive filler suitably applicable herein is Ni powder, and the crystalline polymer resin suitably applicable herein is a polyethylene resin being a thermoplastic resin. The element body 10 is compressed under pressure and heat against the pair of terminal electrodes 12, 14.

Each of the protecting films 16*a*, 16*b*, 16*c*, 16*d* is located so as to cover a portion of the element body 10 not compressed against the terminal electrodes 12, 14. There are four faces where the element body 10 is not compressed against the terminal electrodes 12, 14, and the protecting films 16*a*, 16*b*, 16*c*, 16*d* are arranged along the four respective faces.

The protecting films 16*a*, 16*b*, 16*c*, 16*d* are formed by letting an epoxy resin react with a thiol-type curing agent to form a cured layer while dispersing a filler of a material with a lower oxygen permeability than that of the cured layer, in the cured layer. The filler is preferably an inorganic filler. At least part of the filler is preferably of a plate shape. The protecting films 16*a*, 16*b*, 16*c*, 16*d* preferably contain 5-50% by mass of the filler, based on the total mass of the protecting films.

The protecting films 16*a*, 16*b*, 16*c*, 16*d* are formed, for example, by heating an epoxy resin composition containing the epoxy resin, the thiol-type curing agent, and the filler, to bring about reaction between the epoxy resin and the thiol-type curing agent.

The filler suitably applicable is an inorganic filler, a metal filler, or an organic filler. Examples of the inorganic filler include mica, silica, talc, clay (natural or synthetic smectite, or mixtures thereof, etc.), glass, aluminum hydroxide, magnesium hydroxide, ceramics, and so on. Examples of the metal filler include silver powder, gold powder, copper powder, nickel powder, and so on. Examples of the organic filler include carbon, polyimide, and so on.

A plurality of anchor projections AC and flattened projections FC1 are formed on the surfaces of the respective terminal electrodes 12, 14 between which the element body 10 is interposed.

The anchor projections AC are formed in each of the overlap regions 121, 141, and regions (peel prevention regions) adjoining the overlap regions 121, 141 in the nonoverlap regions 122, 142. From another standpoint, the anchor projections AC are formed in each of the overlap regions 121, 141, and regions where the terminal electrodes 12, 14 overlap each other, in the nonoverlap regions 122, 142.

The flattened projections FC1 are formed in regions except for the peel prevention regions, in the nonoverlap regions 122, 142. From another standpoint, the flattened projections FC1 are formed in the regions where the terminal electrodes 12, 14 do not overlap each other, in the nonoverlap regions 122, 142.

In FIG. 1, the anchor projections AC and the flattened projections FC1 are depicted in relatively larger sizes for description's sake. The practical anchor projections AC and flattened projections FC1 are small projections of sizes too small to visually recognize. The same also applies to the drawings used in the description hereinafter.

Each of the anchor projections AC has a large-size portion and a small-size portion. The large-size portion is located on the tip side in the extending direction of the anchor projection AC from the terminal electrode 12, 14, and is formed so that the circumference thereof in that direction is larger than that of the small-size portion. The small-size portion is provided on the root side of the anchor projection AC with respect to the large-size portion. The shapes of the large-size portions and the small-size portions in the respective anchor projections AC do not always have to be the same. The peripheral shapes of the large-size portion and the small-size portion do not always have to be regular shapes such as a circle or ellipse, but may be irregular shapes.

The adjacent anchor projections AC are arranged so as to be spaced from each other. Therefore, the element body 10 penetrates into hollow portions formed between the anchor projections AC (i.e., the anchor projections AC are embedded in the element body 10), whereby the terminal electrodes 12, 14 and the element body 10 are fixed. The protecting films 16*a*, 16*b*, 16*c*, 16*d* penetrate into the hollow portions formed between the anchor projections AC (i.e., the anchor projections AC are embedded in the protecting films 16*a*, 16*b*, 16*c*, 16*d*), whereby the terminal electrodes 12, 14 and the protecting films 16*a*, 16*b*, 16*c*, 16*d* are fixed.

Each of the flattened projections FC1 has a large-size portion and a small-size portion. The large-size portion is provided on the tip side in the extending direction of the flattened projection FC1 from the terminal electrode 12, 14, and is formed so that the circumference thereof in that direction is larger than that of the small-size portion. A flat surface is formed at the tip of the large-size portion. The small-size portion is provided on the root side of the flattened projection FC1 with respect to the large-size portion. The shapes of the large-size portions and the small-size portions in the respective flattened projections FC1 do not always have to be the same. The peripheral shapes of the large-size portion and the small-size portion do not always have to be regular shapes such as a circle or ellipse, but may be irregular shapes.

The adjacent flattened projections FC1 are arranged so as to be in contact with each other. The flat surfaces of the respective flattened projections FC1 (distal surfaces of the flattened projections FC1) are made so continuous as to form a substantially flat surface. Therefore, the element body 10 and the protecting films 16*a*, 16*b*, 16*c*, 16*d* are substantially prevented from entering the hollow portions formed between the flattened projections. It is, however, noted that the flattened projections FC1 are not perfectly in contact with each other across the entire surface and that some flattened projections FC1 can also be separated from each other as far as no substantial effect is caused on bond strength in joining the terminal electrodes 12, 14 to other terminals.

The first embodiment showed the example wherein the flattened projections FC1 were formed so as to be in contact with each other to form a substantially flat surface, but embodied forms do not always have to be limited to the above-described example as long as a substantially flat surface can be formed. For example, a flattened surface may be formed by cutting or by grinding.

Figure 2:
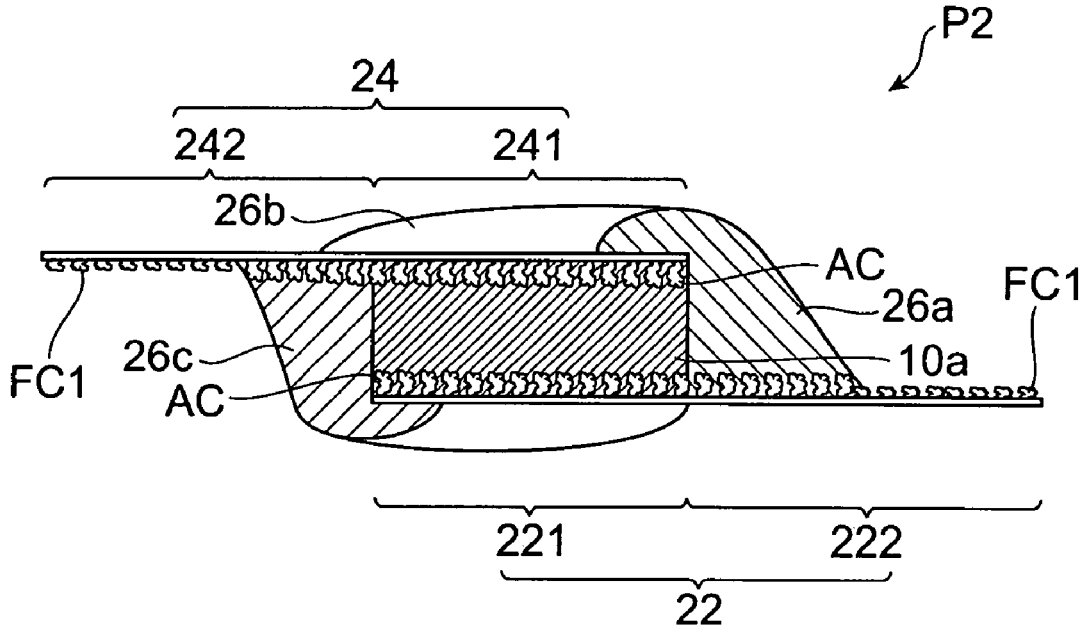
FIG. 2 is a drawing showing a modification example of the PTC element in the first embodiment.

FIG. 2 shows a modification example of the first embodiment. FIG. 2 is a sectional view of PTC element P2 as the modification example. The PTC element P2 comprises a pair of terminal electrodes 22, 24 (lead terminals), an element body 10*a*, and protecting films 26*a*, 26*b*, 26*c*, 26*d*.

The pair of terminal electrodes 22, 24 are formed in the thickness of about 0.1 mm and of Ni or Ni alloy. The pair of terminal electrodes 22, 24 are arranged so as to be opposed in part to each other. Since the element body 10*a* is located between the opposed portions, the element body 10*a* is sandwiched between the opposed surfaces of the respective terminal electrodes 22, 24. Therefore, each of the pair of terminal electrodes 22, 24 is composed of an overlap region 221, 241 overlapping with the element body 10*a*, and a nonoverlap region 222, 242 not overlapping with the element body 10*a*.

The element body 10*a* is formed in much the same shape as the mutually overlapping portions of the terminal electrode 22 and the terminal electrode 24. Since the element body 10*a* is constructed in much the same composition as the element body 10, the description thereof is omitted herein. The element body 10*a* is compressed under pressure and heat against the pair of terminal electrodes 22, 24.

Each of the protecting films 26*a*, 26*b*, 26*c*, 26*d* is located so as to cover a portion of the element body 10*a* not compressed against the terminal electrodes 22, 24. The protecting film 26*d* corresponds to the protecting film 16*d* shown in (a) of FIG. 1, and is not expressly depicted in FIG. 2. There are four faces where the element body 10*a* is not compressed against the terminal electrodes 22, 24, and the protecting films 26*a*, 26*b*, 26*c*, 26*d* are arranged along the four respective faces.

The composition and others of the protecting films 26*a*, 26*b*, 26*c*, 26*d* are much the same as the protecting films 16*a*, 16*b*, 16*c*, 16*d* described above, and the description thereof is thus omitted herein.

A plurality of anchor projections AC and flattened projections FC1 are formed on the surfaces of the respective terminal electrodes 22, 24 between which the element body 10*a* is interposed.

The anchor projections AC are formed in each of the overlap regions 221, 241, and regions (peel prevention regions) adjoining the overlap regions 221, 241 in the nonoverlap regions 222, 242. The flattened projections FC1 are formed in regions except for the peel prevention regions, in the nonoverlap regions 222, 242.

Figure 3:
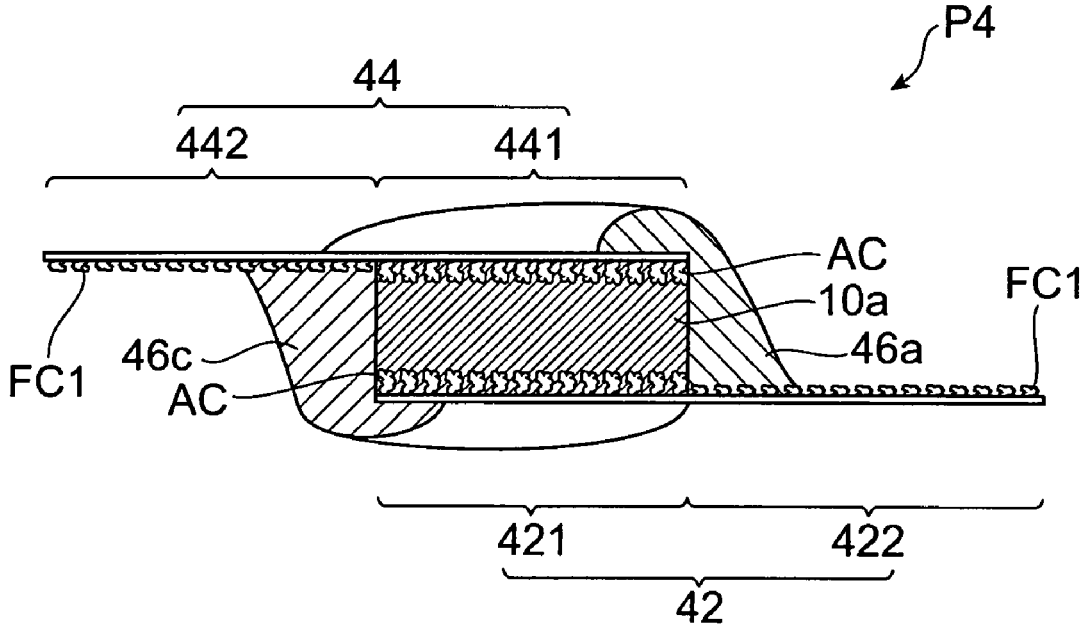
FIG. 3 is a drawing showing a PTC element as a comparative example in the first embodiment.

Subsequently, let us describe the peel prevention effect of the protecting films 16*a*-16*d* and the protecting films 26*a*-26*d* in the PTC element P1 and the PTC element P2 of the first embodiment. A PTC element P4 shown in FIG. 3 is used as a comparative object.

The PTC element P4 comprises a pair of terminal electrodes 42, 44, an element body 10*a*, and protecting films 46*a*, 46*b*, 46*c*, 46*d*.

The pair of terminal electrodes 42, 44 are formed in the thickness of about 0.1 mm and of Ni or Ni alloy. The pair of terminal electrodes 42, 44 are arranged so as to be opposed in part to each other. The element body 10*a* is located between the opposed portions and thus the element body 10*a* is sandwiched between the opposed surfaces of the respective terminal electrodes 42, 44. Therefore, each of the pair of terminal electrodes 42, 44 is composed of an overlap region 421, 441 overlapping with the element body 10*a*, and a nonoverlap region 422, 442 not overlapping with the element body 10*a*.

The element body 10*a* is formed in much the same shape as the mutually overlapping portions of the terminal electrode 42 and the terminal electrode 44. Each of the protecting films 46*a*, 46*c* is located so as to cover a portion of the element body 10*a* not compressed against the terminal electrodes 22, 24.

The protecting films 46*b*, 46*d* corresponding to the protecting films 16*b*, 16*d* shown in FIG. 1 are also formed but are not expressly depicted in FIG. 3. The composition and others of the protecting films 46*a*, 46*c* are much the same as those of the protecting films 16*a*, 16*b*, 16*c*, 16*d* described previously, and thus the description thereof is omitted herein.

A plurality of anchor projections AC and flattened projections FC1 are formed on the surfaces of the respective terminal electrodes 42, 44 between which the element body 10*a* is interposed.

The anchor projections AC are formed only in the overlap regions 421, 441. The flattened projections FC1 are formed in the nonoverlap regions 422, 442.

Figure 4:
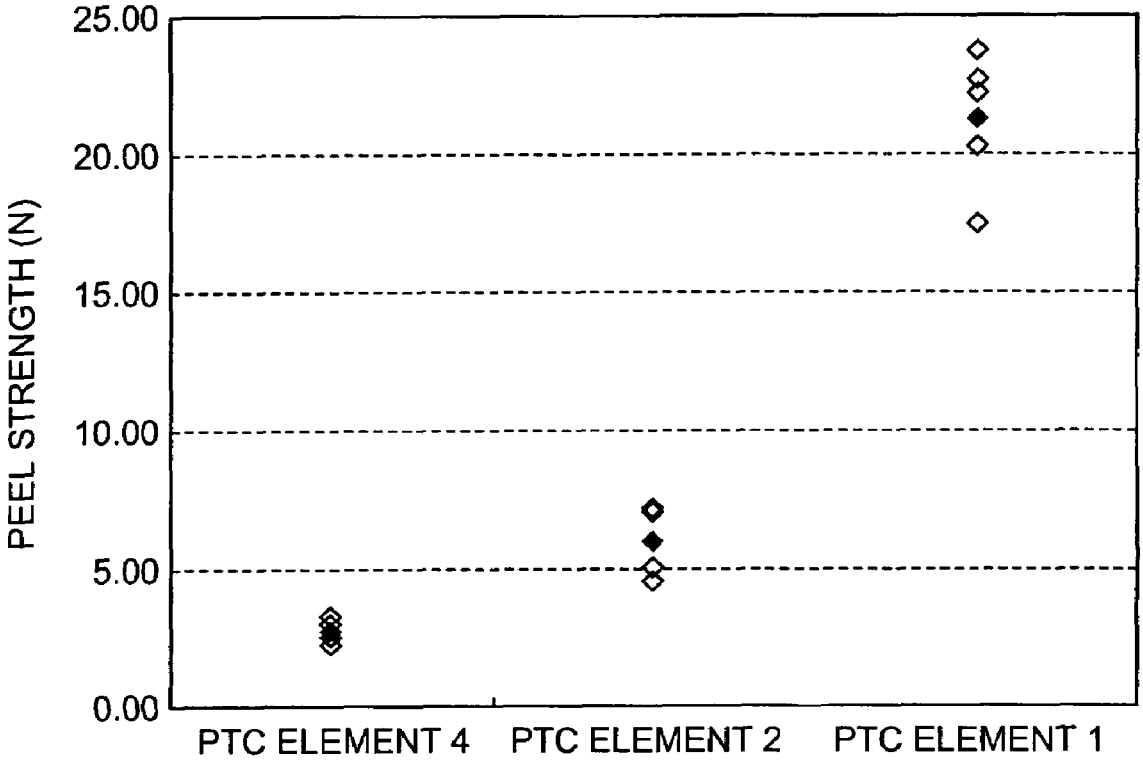
FIG. 4 is a drawing showing the results of comparison between the PTC elements of the first embodiment and the PTC element of the comparative example.

FIG. 4 shows the results of peeling tests of the terminal electrodes with the above-described PTC element P1, PTC element P2, and PTC element P4. FIG. 4 indicates peel strengths of protecting films in the tests of perpendicularly peeling the terminal electrode of each of the PTC element P1, PTC element P2, and PTC element P4 from the element body.

As shown in FIG. 4, the PTC element P1 and the PTC element P2 according to the first embodiment demonstrate peel strengths higher than those of the PTC element P4. Particularly, the PTC element P1 shows extremely high peel strengths. Specifically, the peel strengths of five samples of the PTC element P4 are 2.66 N-3.33 N, and an average thereof is 2.75 N. The peel strengths of five samples of the PTC element P2 are 4.61 N-7.16 N and an average thereof is 5.98 N. The peel strengths of five samples of the PTC element P1 are 17.46 N-23.37 N and an average thereof is 21.26 N.

This is because the anchor projections AC are embedded in the protecting films 16*a*-16*d*, 26*a*-26*d*, so as to increase the peel strength. It is also because the protecting films 16*a*-16*d* are sandwiched between the terminal electrode 12 and the terminal electrode 14, so as to further increase the peel strength.

Subsequently, let us describe a production method of the above-described PTC elements P1, P2. The production method of the PTC elements P1, P2 comprises an element body preparation step, a terminal preparation step, a flattening step, a thermal compression step, and a protecting film forming step.

The element body preparation step is to make and prepare an element body material intended for the element body 10, 10*a*. First, Ni powder to become an electroconductive filler is mixed with polyethylene as a matrix resin to form a block. This block is pressed into a disk shape and cut to obtain an element body material.

The subsequent terminal preparation step is to make and prepare metal plates to become the terminal electrodes 12, 14, 22, 24. The anchor projections AC are formed on the surfaces of the terminal electrodes 12, 14, 22, 24 between which the element body 10, 10*a* is interposed. The anchor projections AC are the aforementioned nodules (nodose projections) formed in a succession.

The flattening step is to crush and flatten the anchor projections AC in the required regions as described above, to form the flattened projections FC1. A press movement amount in this case is 10-35 μm and more preferably 10-15 μm.

The flattened projections FC1 are formed in contact with each other so as to be substantially flattened, as described above. In terms of the thicknesses of the terminal electrodes, the average thickness in the regions where the flattened projections FC1 are formed is smaller than the average thickness in the regions where the anchor projections AC are formed. The average thicknesses can be determined by punching out a piece of a predetermined area as a specimen and obtaining the mass and specific gravity thereof.

For example, in the case of the first embodiment, the preferred thicknesses after the flattening step are as follows: the thicknesses in the overlap regions 121, 141 and in the nonoverlap regions 122, 142 including the peel prevention regions (the regions where the anchor projections AC are formed) are 60-140 μm; the thicknesses in the nonoverlap regions 122, 142 except for the peel prevention regions (the regions where the anchor projections AC are formed) are 50-120 μm. In this case, the average height of the anchor projections AC is 5-40 μm. The thicknesses after the flattening step are more preferably determined as follows: the thicknesses in the overlap regions 121, 141 and in the nonoverlap regions 122, 142 including the peel prevention regions are 95-100 μm; and the thicknesses in the nonoverlap regions 122, 142 except for the peel prevention regions are 80-90 μm. In this case, the average height of the anchor projections AC is 5-20 μm.

When the thicknesses in the overlap regions 121, 141 and in the nonoverlap regions 122, 142 including the peel prevention regions are larger than 140 μm, the terminal electrodes 12, 14 become too thick. For this reason, thermal compression becomes insufficient between the element body 10 and the terminal electrodes 12, 14, and connection strength becomes weaker between the element body 10 and the terminal electrodes 12, 14. Therefore, the thicknesses in the nonoverlap regions 122, 142 except for the peel prevention regions are preferably set to not more than 120 μm in view of the flattening.

When the thicknesses in the nonoverlap regions 122, 142 except for the peel prevention regions are smaller than 50 μm, the strength of the terminal electrodes 12, 14 per se becomes reduced. This makes handling difficult during production steps and after completion of a product, e.g., the element will be bent in the nonoverlap regions 122, 142 except for the peel prevention regions. Therefore, the thicknesses in the overlap regions 121, 141 are preferably not less than 60 μM in view of the flattening of the nonoverlap regions 122, 142.

When the average height of the anchor projections AC is smaller than 5 μm, the anchor effect is not fully exhibited between the element body 10 and the terminal electrodes 12, 14, so as to lower the connection strength between the element body 10 and the terminal electrodes 12, 14. When the average height of the anchor projections AC is larger than 40 μm, the strength of the anchor projections AC per se becomes lowered, and the anchor projections AC will fall off the terminal electrodes 12, 14 during the thermal compression with the element body 10.

The thermal compression step is to interpose the element body material (element body) between the overlap regions 121, 141 in the pair of respective terminal electrodes 12, 14 and to perform thermal compression to fix the pair of terminal electrodes 12, 14 and the element body 10.

The protecting film forming step is to form the protecting films 16*a*, 16*b*, 16*c*, 16*d*. The protecting films 16*a*, 16*b*, 16*c*, 16*d* are formed by letting an epoxy resin react with a thiol-type curing agent to form a cured layer and dispersing a filler of a material with a lower oxygen permeability than that of the cured layer, in the cured layer.

Since the nonoverlap regions 122, 142 are substantially flattened except for the peel prevention regions of the terminal electrodes 12, 14 in the first embodiment, the bond strength is improved in joining to other terminals. Since the peel prevention regions are formed in the nonoverlap regions 122, 142 adjoining the element body, peeling of the protecting films 16*a*-16*d* covering the element body 10 is suppressed.

Figure 5:
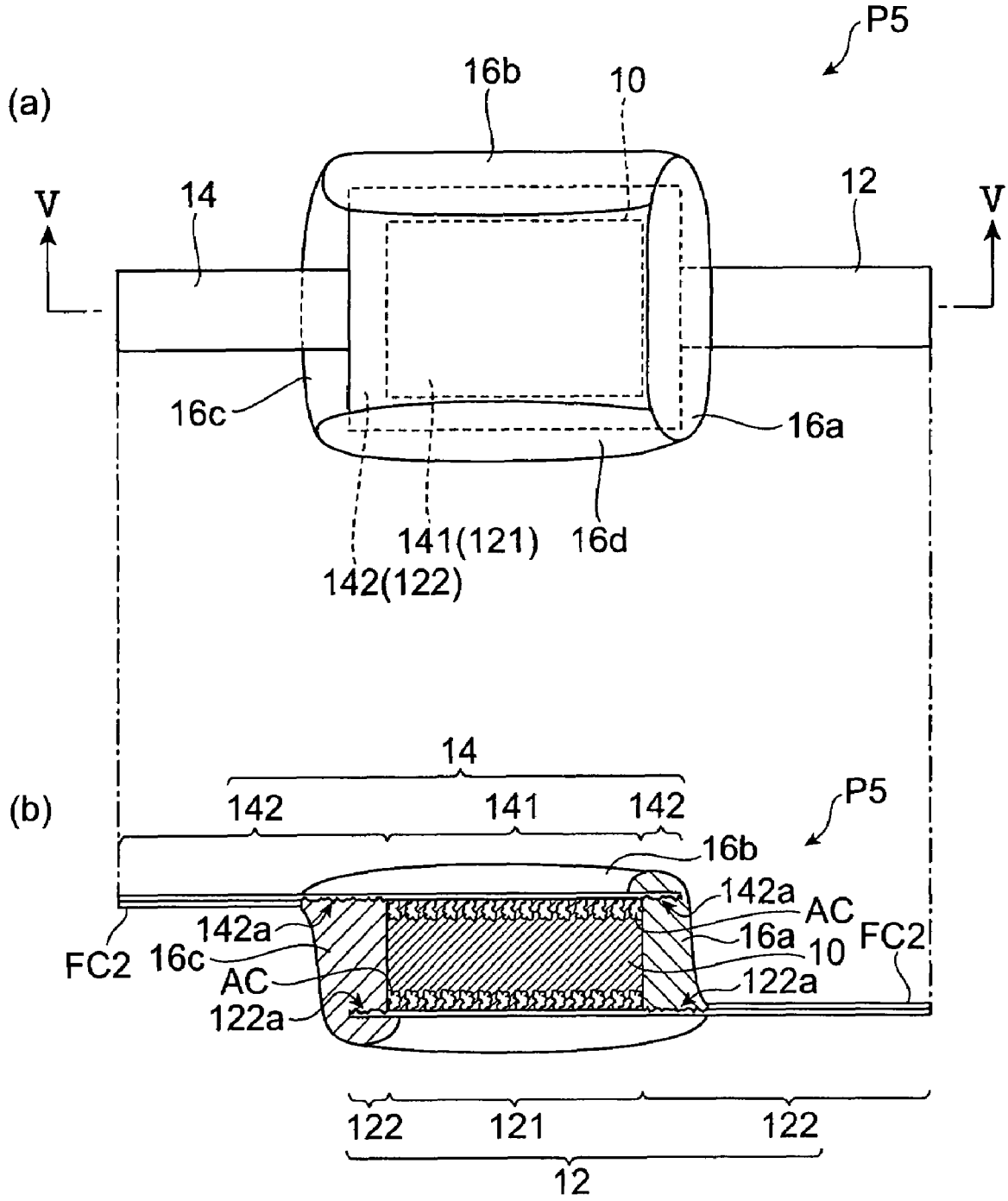
FIG. 5 is a plan view and sectional view showing a PTC element and a modification example in the second embodiment.

A PTC element according to the second embodiment of the present invention will be described with reference to FIG. 5. Part (a) of FIG. 5 is a plan view of PTC element P5 and part (b) of FIG. 5 is a sectional view near the center of the PTC element P5 (along V-V in (a) of FIG. 5). The PTC element P5 is a polymer PTC element and comprises a pair of terminal electrodes 12, 14 (lead terminals), an element body 10, and protecting films 16*a*, 16*b*, 16*c*, 16*d*.

The pair of terminal electrodes 12, 14 are formed in the thickness of about 0.1 mm and of Ni or Ni alloy. The pair of terminal electrodes 12, 14 are arranged so as to be opposed in part to each other. The element body 10 is located between the opposed portions, and the element body 10 is thus sandwiched between the opposed surfaces of the respective terminal electrodes 12, 14. Therefore, each of the pair of terminal electrodes 12, 14 is composed of an overlap region 121, 141 overlapping with the element body 10, and a nonoverlap region 122, 142 not overlapping with the element body 10.

The element body 10 is formed so as to be smaller than the mutually overlapping portions of the terminal electrode 12 and the terminal electrode 14. Therefore, there are the mutually overlapping regions of the terminal electrode 12 and the terminal electrode 14 around the element body 10 and in the nonoverlap regions 122, 142.

The element body 10 is formed by dispersing an electroconductive filler in a crystalline polymer resin. The electroconductive filler suitably applicable herein is Ni powder, and the crystalline polymer resin suitably applicable herein is a polyethylene resin being a thermoplastic resin. The element body 10 is compressed under pressure and heat against the pair of terminal electrodes 12, 14.

A plurality of anchor projections AC and flattened projections FC2 are formed on the surfaces of the respective terminal electrodes 12, 14 between which the element body 10 is interposed, and the regions without the anchor projections AC nor the flattened projections FC2 are roughened. The anchor projections AC are formed in the overlap regions 121, 141.

The roughened regions 122*a*, 142*a* are formed in the nonoverlap regions 122, 142, respectively, adjoining the element body 10. The roughened regions 122*a*, 142*a* are formed at least in the regions in which the terminal electrode 12 and the terminal electrode 14 overlap each other, in the nonoverlap regions 122, 142.

The roughened regions 122*a*, 142*a* are regions that are so roughened as to substantially increase the surface area in the corresponding regions of the terminal electrodes 12, 14. The roughened regions 122*a*, 142*a* are preferably formed by roughening the pertinent surfaces by etching with hydrochloric acid or the like. The roughened regions 122*a*, 142*a* are also preferably formed by machining such as grinding or sandblasting. The roughened regions 122*a*, 142*a* are also preferably formed by first forming the anchor projections AC and thereafter crushing them to a level enough for the later-described protecting films 16*a*, 16*b*, 16*c*, 16*d* to enter, thereby effecting roughening. The roughened regions are not limited by ways of roughening as long as peeling of later-described protecting films 16*a*, 16*b*, 16*c*, 16*d* can be substantially prevented.

The flattened projections FC2 are formed in the regions except for the roughened regions 122*a*, 142*a*, in the nonoverlap regions 122, 142. From another standpoint, the flattened projections FC2 are formed in the regions where the terminal electrodes 12, 14 do not overlap each other, in the nonoverlap regions 122, 142.

In FIG. 5, the anchor projections AC and flattened projections FC2 are depicted in relatively larger sizes for description's sake. The practical anchor projections AC and flattened projections FC2 are small projections of sizes too small to visually recognize. The roughened shapes of the roughened regions 122*a*, 142*a* are schematically depicted. The same also applies to the drawings used in the description hereinafter.

Each of the anchor projections AC has a large-size portion and a small-size portion. The large-size portion is provided on the tip side in the extending direction of the anchor projection AC from the terminal electrode 12, 14, and is formed so that the circumference thereof in that direction is larger than that of the small-size portion. The small-size portion is provided on the root side of the anchor projection AC with respect to the large-size portion. The shapes of the large-size portions and the small-size portions in the respective anchor projections AC do not always have to be the same. The peripheral shapes of the large-size portion and the small-size portion do not always have to be regular shapes such as a circle or ellipse, but may be irregular shapes.

The adjacent anchor projections AC are arranged so as to be spaced from each other. Therefore, the element body 10 penetrates into hollow portions formed between the anchor projections AC (i.e., the anchor projections AC are embedded in the element body 10), whereby the terminal electrodes 12, 14 and the element body 10 are fixed.

Each of the flattened projections FC2 has a large-size portion and a small-size portion. The large-size portion is provided on the tip side in the extending direction of the flattened projection FC2 from the terminal electrode 12, 14 and is formed so that the circumference thereof in that direction is larger than that of the small-size portion. A flat surface is formed at the tip of the large-size portion. The small-size portion is provided on the root side of the flattened projection FC2 with respect to the large-size portion. The shapes of the large-size portions and the small-size portions in the respective flattened projections FC2 do not always have to be the same. The peripheral shapes of the large-size portion and the small-size portion do not always have to be regular shapes such as a circle or ellipse, but may be irregular shapes.

The adjacent flattened projections FC2 are arranged so as to be in contact with each other. The flat surfaces of the respective flattened projections FC2 (distal surfaces of the flattened projections FC2) are made so continuous as to form a substantially flat surface. Therefore, the element body 10 and the protecting films 16*a*, 16*b*, 16*c*, 16*d* are substantially prevented from entering the hollow portions formed between the flattened projections. It is, however, noted that the flattened projections FC2 are not perfectly in contact with each other across the entire surface and that some flattened projections FC2 can be separated from each other as far as no substantial effect is caused on bond strength in joining of the terminal electrodes 12, 14 to other terminals.

The second embodiment showed the example wherein the flattened projections FC2 were formed so as to be in contact with each other to form a substantially flat surface, but embodied forms do not always have to be limited to the above-described example as long as a substantially flat surface can be formed. For example, a flattened surface may be formed by cutting or by grinding.

Each of the protecting films 16*a*, 16*b*, 16*c*, 16*d* is located so as to cover a portion of the element body 10 not compressed against the terminal electrodes 12, 14. There are four faces where the element body 10 is not compressed against the terminal electrodes 12, 14, and the protecting films 16*a*, 16*b*, 16*c*, 16*d* are arranged along the four respective faces.

The protecting films 16*a*, 16*b*, 16*c*, 16*d* are in contact with the terminal electrodes 12, 14 at least in the roughened regions 122*a*, 142*a*. Therefore, the area of contact between the protecting films 16*a*, 16*b*, 16*c*, 16*d* and the terminal electrodes 12, 14 is substantially increased in comparison with a case where they are in contact in the non-roughened regions.

Figure 6:
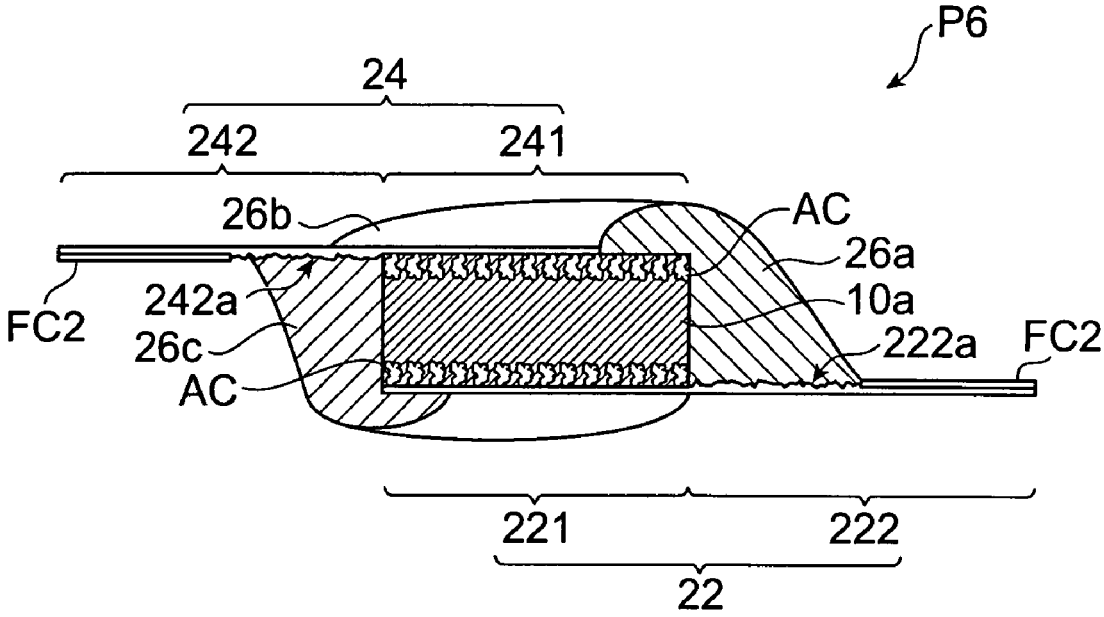
FIG. 6 is a sectional view showing a modification example of the PTC element in the second embodiment.

Subsequently, let us describe a modification example of the second embodiment with reference to FIG. 6. FIG. 6 is a sectional view of PTC element P6 as the modification example. The PTC element P6 is a polymer PTC element and comprises a pair of terminal electrodes 22, 24 (lead terminals), an element body 10*a*, and protecting films 26*a*, 26*b*, 26*c*, 26*d*.

The pair of terminal electrodes 22, 24 are formed in the thickness of about 0.1 mm and of Ni or Ni alloy. The pair of terminal electrodes 22, 24 are arranged so as to be opposed in part to each other. Since the element body 10*a* is located between the opposed portions, the element body 10*a* is sandwiched between the opposed surfaces of the respective terminal electrodes 22, 24. Therefore, each of the pair of terminal electrodes 22, 24 is composed of an overlap region 221, 241 overlapping with the element body 10*a*, and a nonoverlap region 222, 242 not overlapping with the element body 10*a*.

The element body 10*a* is formed in much the same shape as the mutually overlapping portions of the terminal electrode 22 and the terminal electrode 24. Since the element body 10*a* is constructed in much the same composition as the element body 10, the description thereof is omitted herein. The element body 10*a* is compressed under pressure and heat against the pair of terminal electrodes 22, 24.

A plurality of anchor projections AC and flattened projections FC2 are formed on the surfaces of the respective terminal electrodes 22, 24 between which the element body 10*a* is interposed. The anchor projections AC are formed in the overlap regions 221, 241. The regions without the anchor projections AC nor the flattened projections FC2 are roughened. Therefore, the roughened regions 222*a*, 242*a* are formed in the nonoverlap regions 222, 242, respectively, adjoining the element body 10*a*. The form of the roughened regions 222*a*, 242*a* is much the same as that of the roughened regions 122*a*, 142*a*, and thus the description thereof is omitted herein.

Each of the protecting films 26*a*, 26*b*, 26*c*, 26*d* is located so as to cover a portion of the element body 10*a* not compressed against the terminal electrodes 22, 24. The protecting film 26*d* corresponds to the protecting film 16*d* shown in (a) of FIG. 5, and is not expressly depicted in FIG. 6. There are four faces where the element body 10*a* is not compressed against the terminal electrodes 22, 24, and the protecting films 26*a*, 26*b*, 26*c*, 26*d* are arranged along the four respective faces.

The protecting films 26*a*, 26*b*, 26*c*, 26*d* are in contact with the terminal electrodes 22, 24 at least in the roughened regions 222*a*, 242*a*. Therefore, the area of contact between the protecting films 26*a*, 26*b*, 26*c*, 26*d* and the terminal electrodes 22, 24 is substantially increased in comparison with a case where they are in contact in the non-roughened regions.

The composition and others of the protecting films 26*a*, 26*b*, 26*c*, 26*d* are much the same as those of the protecting films 16*a*, 16*b*, 16*c*, 16*d* described above, and thus the description thereof is omitted herein.

Figure 7:
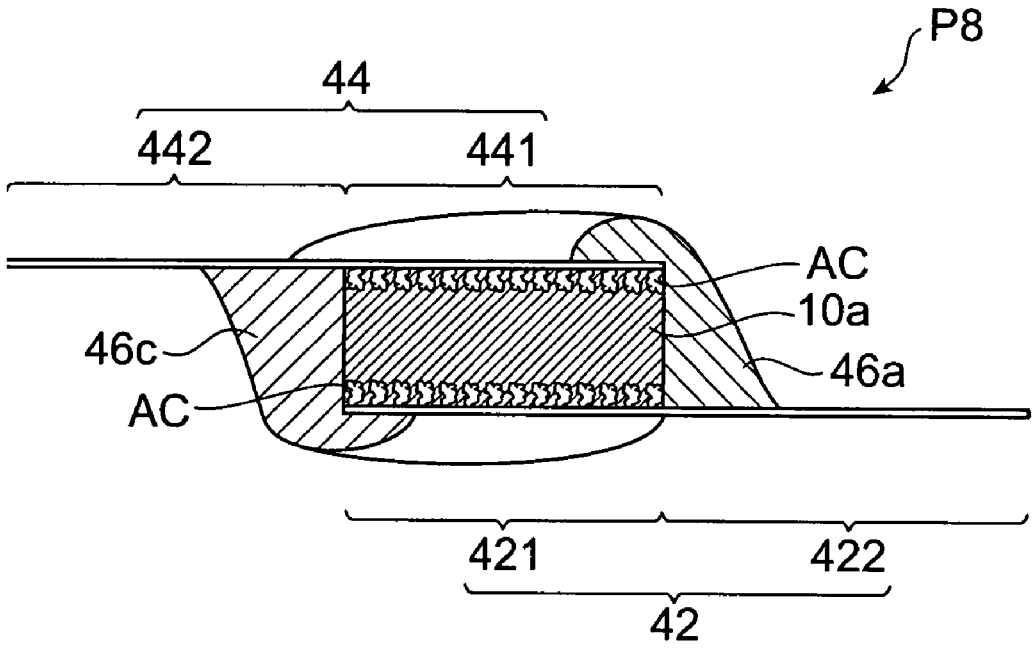
FIG. 7 is a sectional view showing a PTC element as a comparative example in the second embodiment.

Subsequently, let us describe the peel prevention effect of the PTC element P5 and PTC element P6 in the second embodiment. In the description of this effect, Example 1 is defined as an element formed in the form of the PTC element P5 wherein the roughened regions 122*a*, 142*a* were made by etching, and Example 2 as an element formed in the form of the PTC element P5 wherein the roughened regions 122*a*, 142*a* were made by crushing the anchor projections. Example 3 is defined as an element formed in the form of the PTC element P6 wherein the roughened regions 222*a*, 242*a* were made by etching, and Example 4 as an element formed in the form of the PTC element P6 wherein the roughened regions 222*a*, 242*a* were made by crushing the anchor projections. A comparative example is a PTC element P8 shown in FIG. 7.

The PTC element P8 comprises a pair of terminal electrodes 42, 44, an element body 10*a*, and protecting films 46*a*, 46*b*, 46*c*, 46*d*.

The pair of terminal electrodes 42, 44 are formed in the thickness of about 0.1 mm and of Ni or Ni alloy. The pair of terminal electrodes 42, 44 are arranged so as to be opposed in part to each other. The element body 10*a* is located between the opposed portions and thus the element body 10*a* is sandwiched between the opposed surfaces of the respective terminal electrodes 42, 44. Therefore, each of the pair of terminal electrodes 42, 44 is composed of an overlap region 421, 441 overlapping with the element body 10*a*, and a nonoverlap region 422, 442 not overlapping with the element body 10*a*.

The element body 10*a* is formed in much the same shape as the mutually overlapping portions of the terminal electrode 42 and the terminal electrode 44. Each of the protecting films 46*a*, 46*c* is located so as to cover a portion of the element body 10*a* not compressed against the terminal electrodes 22, 24. The protecting films corresponding to the protecting films 16*b*, 16*d* shown in FIG. 5 are also formed but are not expressly depicted in FIG. 7. The composition and others of the protecting films 46*a*, 46*c* are much the same as those of the protecting films 16*a*, 16*b*, 16*c*, 16*d* described previously, and thus the description thereof is omitted herein.

A plurality of anchor projections AC are formed on the surfaces of the respective terminal electrodes 42, 44 between which the element body 10*a* is interposed. The anchor projections AC are formed only in the overlap regions 421, 441. The portions of the terminal electrodes 42, 44 in contact with the protecting films 46*a*, 46*c* are smooth and not roughened.

Figure 8:
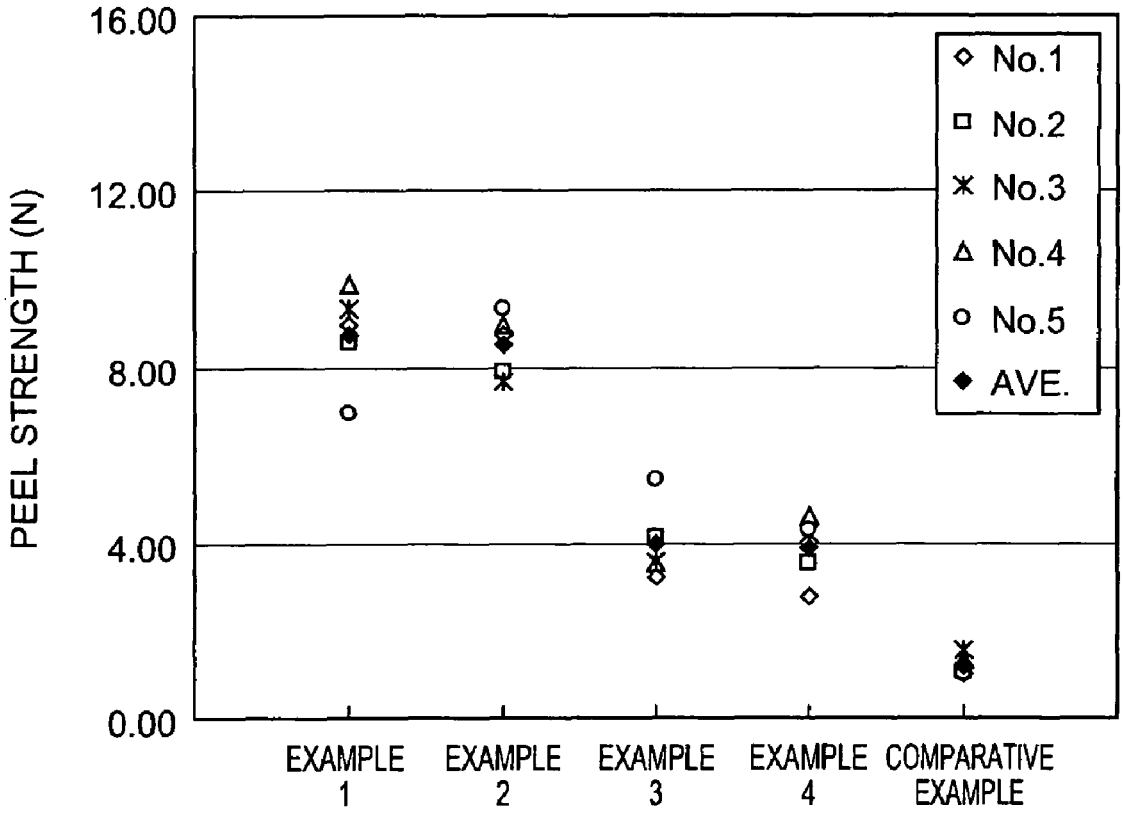
FIG. 8 is a drawing showing the results of comparison between the PTC elements of the second embodiment and the PTC element of the comparative example.

FIG. 8 shows the results of peel strength tests of terminal electrodes with Example 1, Example 2, Example 3, Example 4, and Comparative Example described above. FIG. 8 indicates the peel strengths of the protecting films in the tests of perpendicularly peeling the terminal electrode of each of Example 1, Example 2, Example 3, Example 4, and Comparative Example from the element body.

As shown in FIG. 8, the peel strengths of Example 1, Example 2, Example 3, and, Example 4 according to the second embodiment are higher than those of Comparative Example. Particularly, Example 1 and Example 2 demonstrate extremely higher peel strengths than those of Comparative Example. Specifically, the peel strengths of five samples of Example 1 are 6.93 N-9.87 N, and an average thereof is 8.74 N. The peel strengths of five samples of Example 2 are 7.65 N-9.33 N, and an average thereof is 8.52 N. The peel strengths of five samples of Example 3 are 3.23 N-5.43 N, and an average thereof is 3.98 N. The peel strengths of five samples of Example 4 are 2.75 N-4.61 N, and an average thereof is 3.89 N. The peel strengths of five samples of Comparative Example are 0.98 N-1.55 N, and an average thereof is 1.17 N.

A conceivable reason why the peel strengths of Examples 1-4 are increased relative to those of Comparative Example is that the contact area between the protecting films 16*a*-16*d* (26*a*-26*d*) and the terminal electrodes 12, 14 (22, 24) is substantially increased by the formation of the roughened regions 122*a*, 142*a* (222*a*, 242*a*). Since in Examples 1 and 2 the protecting films 16*a*-16*d* are sandwiched between the terminal electrode 12 and the terminal electrode 14, the peel strengths are considered to be further increased.

Next, let us describe a production method of the above-described PTC elements P5, P6. The production method of PTC elements P5, P6 comprises an element body preparation step, a terminal preparation step, a roughening step, a flattening step, a thermal compression step, and a protecting film forming step.

The element body preparation step is to make and prepare an element body material intended for the element body 10, 10*a*. First, Ni powder to become an electroconductive filler is mixed with polyethylene as a matrix resin to form a block. This block is pressed into a disk shape and cut to obtain an element body material.

The subsequent terminal preparation step is to make and prepare metal plates to become the terminal electrodes 12, 14, 22, 24. The anchor projections AC are formed on the surfaces of the terminal electrodes 12, 14, 22, 24 between which the element body 10, 10*a* is interposed. The anchor projections AC are the aforementioned nodules formed in a succession.

The roughening step is to effect etching with hydrochloric acid on the terminal electrodes 12, 14, 22, 42 to form the roughened regions 122*a*, 142*a*, 222*a*, 242*a*, before fixing the terminal electrodes 12, 14 and the element body 10 or before fixing the terminal electrodes 22, 24 and the element body 10*a* as described above.

In another form, the roughened regions 122*a*, 142*a*, 222*a*, 242*a* may be formed by machining such as grinding or sandblasting. In still another form, the roughened regions 122*a*, 142*a*, 222*a*, 242*a* may be formed by crushing the anchor projections AC so as to leave an uneven shape.

The flattening step is to crush and flatten the anchor projections AC in the required regions as described above, to form the flattened projections FC2. A press movement amount in this case is 10-35 μm and more preferably 10-15 μm. Embodied forms are not limited to those described above as long as the substantially flat surface can be formed. For example, the flattening may be implemented by cutting or grinding.

The flattened projections FC2 are formed in contact with each other so as to be substantially flattened, as described above. In terms of the thicknesses of the terminal electrodes, the average thickness in the regions where the flattened projections FC2 are formed is smaller than the average thickness in the regions where the anchor projections AC are formed. The average thicknesses can be determined by punching out a piece of a predetermined area as a specimen and obtaining the mass and specific gravity thereof.

For example, in the case of the second embodiment, the preferred thicknesses after the flattening step are as follows: the thicknesses in the overlap regions 121, 141 (the regions where the anchor projections AC are formed) are 60-140 μm; and the thicknesses in the nonoverlap regions 122, 142 are 50-120 μm. In this case, the average height of the anchor projections AC is 5-40 μm. The thicknesses after the flattening step are more preferably determined as follows: the thicknesses in the overlap regions 121, 141 are 95-100 μm, and the thicknesses in the nonoverlap regions 122, 142 are 80-90 μm. In this case, the average height of the anchor projections AC is 5-20 μm.

When the thicknesses in the overlap regions 121, 141 are larger than 140 μm, the terminal electrodes 12, 14 become too thick. For this reason, thermal compression becomes insufficient between the element body 10 and the terminal electrodes 12, 14, and connection strength becomes weaker between the element body 10 and the terminal electrodes 12, 14. Therefore, the thicknesses in the nonoverlap regions 122, 142 are preferably not more than 120 μm in view of the flattening.

When the thicknesses in the nonoverlap regions 122, 142 are smaller than 50 μm, the strength of the terminal electrodes 12, 14 per se becomes reduced. This makes handling difficult during production steps and after completion of a product, e.g., the element will be bent in the nonoverlap regions 122, 142. Therefore, the thicknesses in the overlap region 121, 141 are preferably not less than 60 μm in view of the flattening of the nonoverlap region 122, 142.

When the average height of the anchor projections AC is smaller than 5 μm, the anchor effect is not fully exhibited between the element body 10 and the terminal electrodes 12, 14, so as to lower the connection strength between the element body 10 and the terminal electrodes 12, 14. When the average height of the anchor projections AC is larger than 40 μm, the strength of the anchor projections AC per se becomes lowered, and the anchor projections AC will fall off the terminal electrodes 12, 14 during the thermal compression with the element body 10.

The thermal compression step is to interpose the element body material (element body) between the overlap regions 121, 141 in the pair of respective terminal electrodes 12, 14 and to perform thermal compression to fix the pair of terminal electrodes 12, 14 and the element body 10.

The protecting film forming step is to form the protecting films 16*a*, 16*b*, 16*c*, 16*d*. The protecting films 16*a*, 16*b*, 16*c*, 16*d* are formed by letting an epoxy resin react with a-thiol-type curing agent to form a cured layer and dispersing a filler of a material with a lower oxygen permeability than that of the cured layer, in the cured layer.

Since the nonoverlap regions 122, 142 are substantially flattened except for the roughened regions 122*a*, 142*a* of the terminal electrodes 12, 14 in the second embodiment, the bond strength is improved in joining to other terminals. Since the roughened regions 122*a*, 142*a* are formed in the nonoverlap regions 122, 142 adjoining the element body 10, peeling of the protecting films 16*a*-16*d* covering the element body 10 is effectively suppressed.

Figure 9:
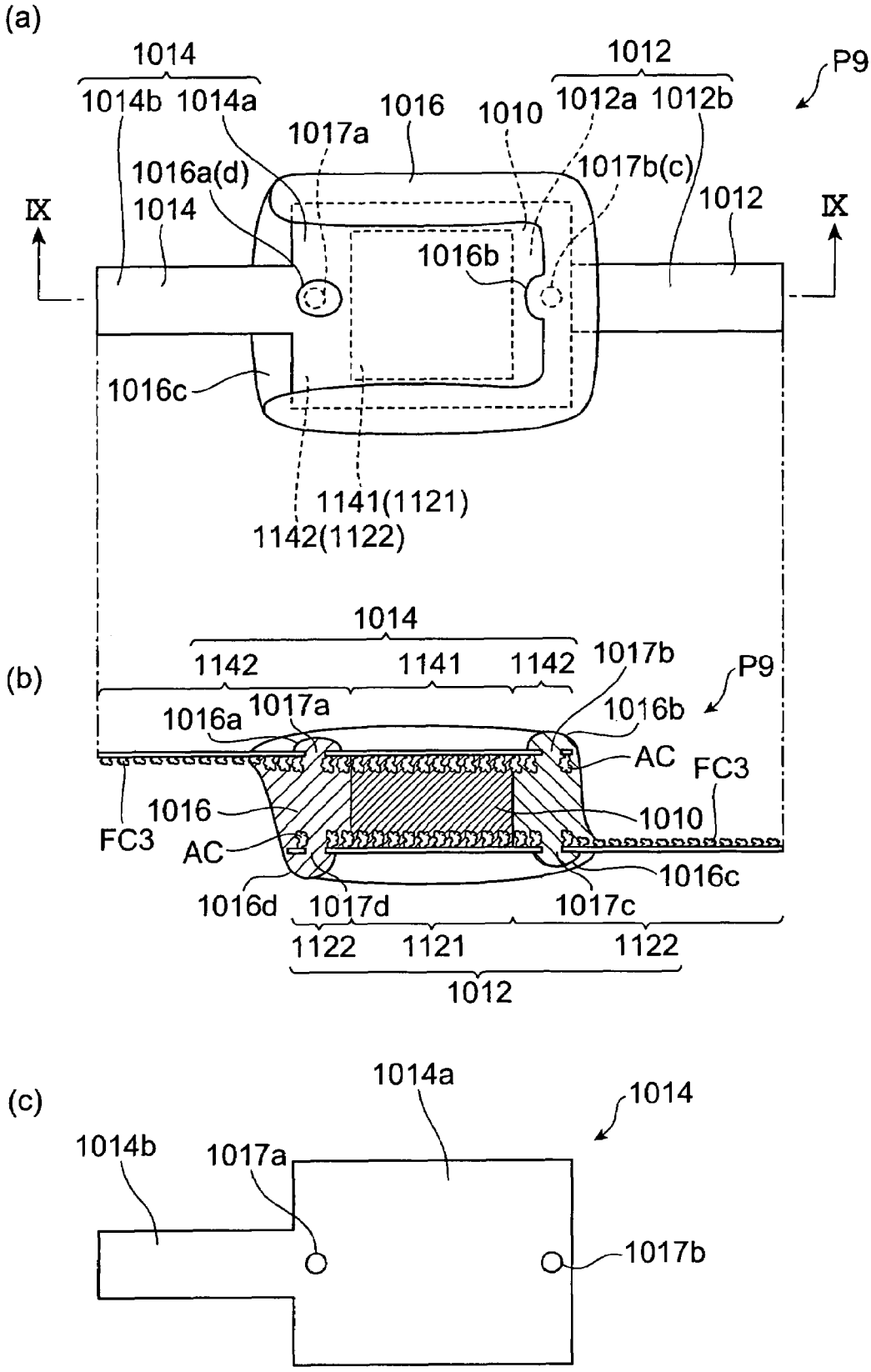
FIG. 9 is a plan view and sectional view showing a PTC element in the third embodiment.

A PTC element according to the third embodiment of the present invention will be described with reference to FIG. 9. Part (a) of FIG. 9 is a plan view of PTC element P9, part (b) of FIG. 9 a sectional view near the center of the PTC element P9 (along IV-IV in (a) of FIG. 9), and part (c) of FIG. 9 a plan view of terminal electrode 1014 being a constitutive element of the PTC element P9. The PTC element P9 is a polymer PTC element and comprises a pair of terminal electrodes 1012, 1014 (lead terminals), an element body 1010, and protecting films 1016.

The pair of terminal electrodes 1012, 1014 are formed in the thickness of about 0.1 mm and of Ni or Ni alloy. Each of the terminal electrodes 1012, 1014 has a first portion 1012*a*, 1014*a* and a second portion 1012*b*, 1014*b*. The second portion 1012*b*, 1014*b* is formed so as to extend from a nearly central region of one side of the first portion 1012*a*, 1014*a*. The second portion 1012*b*, 1014*b* is formed in a width smaller than that of the first portion 1012*a*, 1014*a*. The pair of terminal electrodes 1012, 1014 are arranged so that the first portions 1012*a*, 1014*a* are opposed to each other. Since the element body 1010 is disposed between the first portions 1012*a*, 1014*a* opposed to each other, the element body 1010 is sandwiched between the opposed surfaces of the respective terminal electrodes 1012, 1014. Therefore, each of the pair of terminal electrodes 1012, 1014 is composed of an overlap region 1121, 1141 overlapping with the element body 1010, and a nonoverlap region 1122, 1142 not overlapping with the element body 1010.

Through holes 1017*a*, 1017*b*, 1017*c*, 1017*d* are formed in the nonoverlap regions 1122, 1142 of the respective terminal electrodes 1012, 1014. The through holes 1017*a*, 1017*b* are formed in a peel prevention region included in the nonoverlap region 1142 of the terminal electrode 1014. The peel prevention region is a region adjoining the overlap region 1141, in the nonoverlap region 1142.

The through hole 1017*a* is formed in the first portion 1014*a* of the terminal electrode 1014 and near an approximate center of the side from which the second portion 1014*b* extends. The through hole 1017*b* is formed in the first portion 1014*a* of the terminal electrode 1014 and near an approximate center of the side opposite to the side from which the second portion 1014*b* extends.

The through holes 1017*c*, 1017*d* are formed in a peel prevention region included in the nonoverlap region 1122 of the terminal electrode 1012. The peel prevention region is a region adjoining the overlap region 1121, in the nonoverlap region 1122. The through hole 1017*c* is formed in the first portion 1012*a* of the terminal electrode 1012 and near an approximate center of the side from which the second portion 1012*b* extends. The through hole 1017*d* is formed in the first portion 1012*a* of the terminal electrode 1012 and near an approximate center of the side opposite to the side from which the second portion 1012*b* extends.

In the viewing direction of the plan view in (a) of FIG. 9, each set of the through holes 1017*a* and 1017*d* and the through holes 1017*b* and 1017*c* are formed so as to overlap each other at corresponding positions.

The element body 1010 is formed so as to be smaller than the mutually overlapping portions of the terminal electrode 1012 and the terminal electrode 1014. Therefore, the nonoverlap regions 1122, 1142 are formed around the element body 1010 so that they do not overlap with the element body 1010, while the terminal electrode 1012 and the terminal electrode 1014 overlap each other.

The element body 1010 is formed by dispersing an electroconductive filler in a crystalline polymer resin. The electroconductive filler suitably applicable herein is Ni powder, and the crystalline polymer resin suitably applicable herein is a polyethylene resin being a thermoplastic resin. The element body 1010 is compressed under pressure and heat against the pair of terminal electrodes 1012, 1014.

Each of the protecting films 1016 is located so as to cover a portion of the element body 1010 not compressed against the terminal electrodes 1012, 1014. There are four faces where the element body 1010 is not compressed against the terminal electrodes 1012, 1014, and the protecting films 1016 are arranged along the four respective faces.

The protecting films 1016 include anchor protecting films 1016*a*, 1016*b*, 1016*c*, 1016*d*. The anchor protecting films 1016*a*, 1016*b*, 1016*c*, 1016*d* are portions of the protecting films penetrating through the respective through holes 1017*a*, 1017*b*, 1017*c*, 1017*d* to the opposing surface of the terminal electrode 1012, 1014. The anchor protecting films 1016*a*, 1016*b*, 1016*c*, 1016*d* are formed so as to cover the through holes 1017*a*, 1017*b*, 1017*c*, 1017*d*, respectively. Therefore, the protecting films are formed so that the terminal electrodes 1012, 1014 are pinched by the whole of the protecting films 1016 by virtue of anchor effects of the respective anchor protecting films 1016*a*, 1016*b*, 1016*c*, 1016*d* through the through holes 1017*a*, 1017*b*, 1017*c*, 1017*d*, whereby the terminal electrodes 1012, 1014 and the protecting films 1016 are fixed.

The protecting films 1016 are formed by letting an epoxy resin react with a thiol-type curing agent to form a cured layer while dispersing a filler of a material with a lower oxygen permeability than that of the cured layer, in the cured layer. The filler is preferably an inorganic filler. At least part of the filler is preferably of a plate shape. The protecting films 1016 preferably contain 5-50% by mass of the filler, based on the total mass of the protecting films.

The protecting films 1016 are formed, for example, by heating an epoxy resin composition containing the epoxy resin, the thiol-type curing agent, and the filler, to bring about reaction between the epoxy resin and the thiol-type curing agent.

The filler suitably applicable is an inorganic filler, a metal filler, or an organic filler. Examples of the inorganic filler include mica, silica, talc, clay (natural or synthetic smectite, or mixtures thereof, etc.), glass, aluminum hydroxide, magnesium hydroxide, ceramics, and so on. Examples of the metal filler include silver powder, gold powder, copper powder, nickel powder, and so on. Examples of the organic filler include carbon, polyimide, and so on.

A plurality of anchor projections AC and flattened projections FC3 are formed on the surfaces of the respective terminal electrodes 1012, 1014 between which the element body 1010 is interposed.

The anchor projections AC are formed in each of the overlap regions 1121, 1141, and the peel prevention regions adjoining the overlap regions 1121, 1141 in the nonoverlap regions 1122, 1142. From another standpoint, the anchor projections AC are formed in each of the overlap regions 1121, 1141, and regions where the terminal electrodes 1012, 1014 overlap each other, in the nonoverlap regions 1122, 1142.

The flattened projections FC3 are formed in regions except for the peel prevention regions, in the nonoverlap regions 1122, 1142. From another standpoint, the flattened projections FC3 are formed in the regions where the terminal electrodes 1012, 1014 do not overlap each other, in the nonoverlap regions 1122, 1142.

In FIG. 9, the anchor projections AC and the flattened projections FC3 are depicted in relatively larger sizes for description's sake. The practical anchor projections AC and flattened projections FC3 are small projections of sizes too small to visually recognize. The same also applies to the drawings used in the description hereinafter.

Each of the anchor projections AC has a large-size portion and a small-size portion. The large-size portion is located on the tip side in the extending direction of the anchor projection AC from the terminal electrode 1012, 1014, and is formed so that the circumference thereof in that direction is larger than that of the small-size portion. The small-size portion is provided on the root side of the anchor projection AC with respect to the large-size portion. The shapes of the large-size portions and the small-size portions in the respective anchor projections AC do not always have to be the same. The peripheral shapes of the large-size portion and the small-size portion do not always have to be regular shapes such as a circle or ellipse, but may be irregular shapes.

The adjacent anchor projections AC are arranged so as to be spaced from each other. Therefore, the element body 1010 penetrates into hollow portions formed between the anchor projections AC (i.e., the anchor projections AC are embedded in the element body 1010), whereby the terminal electrodes 1012, 1014 and the element body 1010 are fixed. The protecting films 1016 penetrate into the hollow portions formed between the anchor projections AC (i.e., the anchor projections AC are embedded in the protecting films 1016), whereby the terminal electrodes 1012, 1014 and the protecting films 1016 are fixed more firmly.

Each of the flattened projections FC3 has a large-size portion and a small-size portion. The large-size portion is provided on the tip side in the extending direction of the flattened projection FC3 from the terminal electrode 1012, 1014, and is formed so that the circumference thereof in that direction is larger than that of the small-size portion. A flat surface is formed at the tip of the large-size portion. The small-size portion is provided on the root side of the flattened projection FC3 with respect to the large-size portion. The shapes of the large-size portions and the small-size portions in the respective flattened projections FC3 do not always have to be the same. The peripheral shapes of the large-size portion and the small-size portion do not always have to be regular shapes such as a circle or ellipse, but may be irregular shapes.

The adjacent flattened projections FC3 are arranged so as to be in contact with each other. The flat surfaces of the respective flattened projections FC3 (distal surfaces of the flattened projections FC3) are made so continuous as to form a substantially flat surface. Therefore, the element body 1010 and the protecting films 1016 are substantially prevented from entering the hollow portions formed between the flattened projections. It is, however, noted that the flattened projections FC3 are not perfectly in contact with each other across the entire surface and that some flattened projections FC3 can also be separated from each other as far as no substantial effect is caused on bond strength in joining the terminal electrodes 1012, 1014 to other terminals.

The third embodiment showed the example wherein the flattened projections FC3 were formed so as to be in contact with each other to form a substantially flat surface, but embodied forms do not always have to be limited to the above-described example as long as a substantially flat surface can be formed. For example, a flattened surface may be formed by cutting or by grinding.

Figure 10:
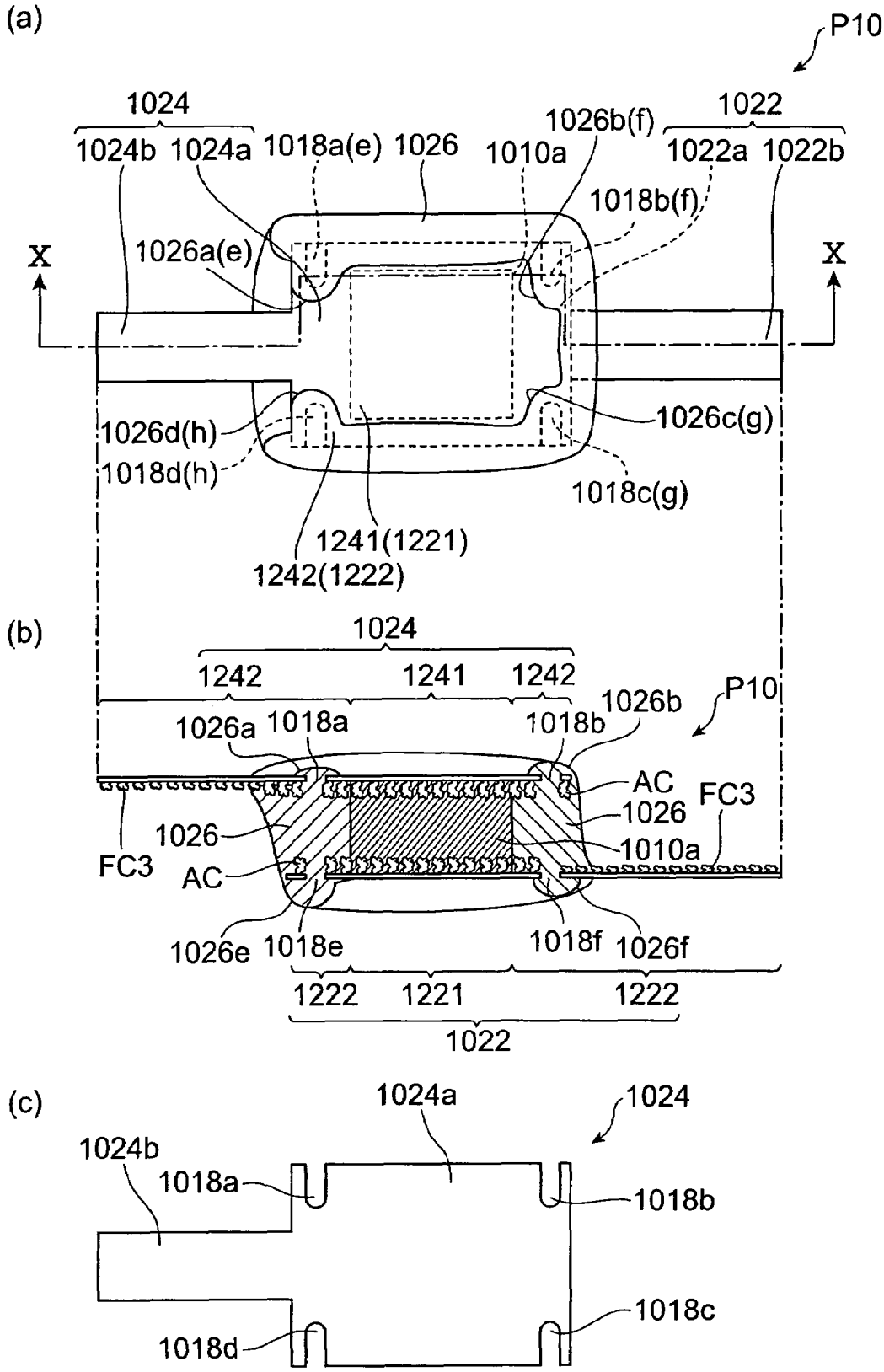
FIG. 10 is a drawing showing a first modification example of the PTC element in the third embodiment.

FIG. 10 shows a first modification example of the third embodiment. Part (a) of FIG. 10 is a plan view of PTC element P10 as the first modification example, part (b) of FIG. 10 a sectional view of the PTC element P10 near an edge thereof (along X-X in (a) of FIG. 10), and part (c) of FIG. 10 a plan view of terminal electrode 1024 being a constitutive element of the PTC element P10. The PTC element P10 comprises a pair of terminal electrodes 1022, 1024, an element body 1010*a*, and protecting films 1026.

The pair of terminal electrodes 1022, 1024 are formed in the thickness of about 0.1 mm and of Ni or Ni alloy. Each of the terminal electrodes 1022, 1024 has a first portion 1022*a*, 1024*a* and a second portion 1022*b*, 1024*b*. The second portion 1022*b*, 1024*b* is formed so as to extend from a nearly central region of one side of the first portion 1022*a*, 1024*a*. The second portion 1022*b*, 1024*b* is formed in a width smaller than that of the first portion 1022*a*, 1024*a*. The pair of terminal electrodes 1022, 1024 are arranged so that the first portions 1022*a*, 1024*a* are opposed to each other. Since the element body 1010*a* is disposed between the first portions 1022*a*, 1024*a* opposed to each other, the element body 1010*a* is sandwiched between the opposed surfaces of the respective terminal electrodes 1022, 1024. Therefore, each of the pair of terminal electrodes 1022, 1024 is composed of an overlap region 1221, 1241 overlapping with the element body 1010*a*, and a nonoverlap region 1222, 1242 not overlapping with the element body 1010*a*.

Notches 1018*a*, 1018*b*, 1018*c*, 1018*d*, 1018*e*, 1018*f*, 1018*g*, 1018*h* are formed in the nonoverlap regions 1222, 1242 of the respective terminal electrodes 1022, 1024.

The notches 1018*a*, 1018*b*, 1018*c*, 1018*d* are formed in a peel prevention region included in the nonoverlap region 1242 of the terminal electrode 1024. The notches 1018*a*, 1018*d* are formed along the side from which the second portion 1024*b* extends, and from the two respective sides adjoining the side from which the second portion 1024*b* extends, in the first portion 1024*a* of the terminal electrode 1024. The notches 1018*b*, 1018*c* are formed along the side opposite to the side from which the second portion 1024*b* extends, and from the two respective sides adjoining the side from which the second portion 1024*b* extends, in the first portion 1024*a* of the terminal electrode 1024.

The notches 1018*e*, 1018*f*, 1018*g*, 1018*h* are formed in a peel prevention region included in the nonoverlap region 1222 of the terminal electrode 1022. The notches 1018*e*, 1018*h* are formed along the side from which the second portion 1022*b* extends, and from the two respective sides adjoining the side from which the second portion 1024*b* extends, in the first portion 1022*a* of the terminal electrode 1022. The notches 1018*f*, 1018*g* are formed along the side opposite to the side from which the second portion 1022*b* extends, and from the two respective sides adjoining the side from which the second portion 1022*b* extends, in the first portion 1022*a* of the terminal electrode 1022.

In the viewing direction of the plan view in (a) of FIG. 10, each set of the notches 1018*a* and 1018*e*, the notches 1018*b* and 1018*f*, the notches 1018*c* and 1018*g*, and the notches 1018*d* and 1018*h* are formed so as to overlap each other at corresponding positions.

The element body 1010*a* is formed so as to be smaller than the mutually overlapping portions of the terminal electrode 1022 and the terminal electrode 1024. Therefore, the nonoverlap regions 1222, 1242 are formed around the element body 1010*a* so that they do not overlap with the element body 1010*a*, while the terminal electrode 1022 and the terminal electrode 1024 overlap each other. The element body 1010*a* is compressed under pressure and heat against the pair of terminal electrodes 1022, 1024.

Each of the protecting films 1026 is located so as to cover a portion of the element body 1010*a* not compressed against the terminal electrodes 1022, 1024. There are four faces where the element body 1010*a* is not compressed against the terminal electrodes 1022, 1024, and the protecting films 1026 are arranged along the four respective faces.

The protecting films 1026 include anchor protecting films 1026*a*, 1026*b*, 1026*c*, 1026*d*, 1026*e*, 1026*f*, 1026*g*, 1026*h*. The anchor protecting films 1026*a*, 1026*b*, 1026*c*, 1026*d*, 1026*e*, 1026*f*, 1026*g*, 1026*h* are portions of the protecting films penetrating through the respective notches 1018*a*, 1018*b*, 1018*c*, 1018*d*, 1018*e*, 1018*f*, 1018*g*, 1018*h* to the opposing surface of the terminal electrode 1022, 1024.

The anchor protecting films 1026*a*, 1026*b*, 1026*c*, 1026*d*, 1026*e*, 1026*f*, 1026*g*, 1026*h* are formed so as to cover the notches 1018*a*, 1018*b*, 1018*c*, 1018*d*, 1018*e*, 1018*f*, 1018*g*, 1018*h*, respectively. Therefore, the protecting films 1026 are formed so that the terminal electrodes 1022, 1024 are pinched by the whole protecting films by virtue of anchor effects of the respective anchor protecting films 1026*a*, 1026*b*, 1026*c*, 1026*d*, 1026*e*, 1026*f*, 1026*g*, 1026*h* through the notches 1018*a*, 1018*b*, 1018*c*, 1018*d*, 1018*e*, 1018*f*, 1018*g*, 1018*h*, whereby the terminal electrodes 1022, 1024 and the protecting films 1026 are fixed.

The compositions and others of the element body 1010*a* and the protecting films 1026 are much the same as those of the element body 1010 and the protecting films 1016 described above, and thus the description thereof is omitted herein.

Figure 11:
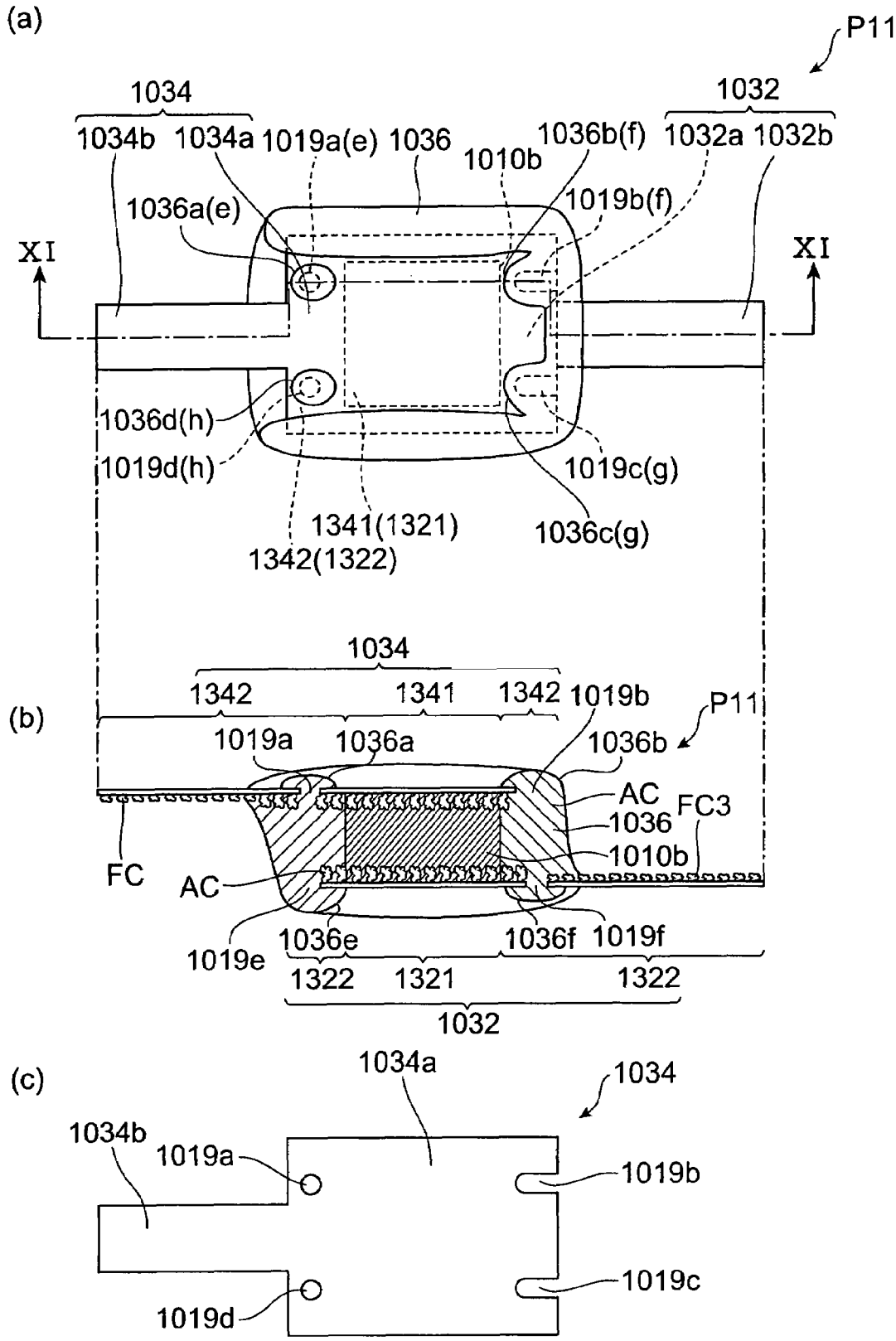
FIG. 11 is a drawing showing a second modification example of the PTC element in the third embodiment.

FIG. 11 shows a second modification example of the third embodiment. Part (a) of FIG. 11 is a plan view of PTC element P11 as the second modification example, part (b) of FIG. 11 a sectional view of the PTC element P11 near an edge thereof (along XI-XI in (a) of FIG. 11), and part (c) of FIG. 11 a plan view of terminal electrode 1034 being a constitutive element of the PTC element P11. The PTC element P11 comprises a pair of terminal electrodes 1032, 1034, an element body 1010*b*, and protecting films 1036.

The pair of terminal electrodes 1032, 1034 are formed in the thickness of about 0.1 mm and of Ni or Ni alloy. Each of the terminal electrodes 1032, 1034 has a first portion 1032*a*, 1034*a* and a second portion 1032*b*, 1034*b*. The second portion 1032*b*, 1034*b* is formed so as to extend from a nearly central region of one side of the first portion 1032*a*, 1034*a*. The second portion 1032*b*, 1034*b* is formed in a width smaller than that of the first portion 1032*a*, 1034*a*. The pair of terminal electrodes 1032, 1034 are arranged so that the first portions 1032*a*, 1034*a* are opposed to each other. Since the element body 1010*b* is disposed between the first portions 1032*a*, 1034*a* opposed to each other, the element body 1010*b* is sandwiched between the opposed surfaces of the respective terminal electrodes 1032, 1034. Therefore, each of the pair of terminal electrodes 1032, 1034 is composed of an overlap region 1321, 1341 overlapping with the element body 1010*b*, and a nonoverlap region 1322, 1342 not overlapping with the element body 1010*b*.

Through holes 1019*a*, 1019*d*, 1019*e*, 1019*h* and notches 1019*b*, 1019*c*, 1019*f*, 1019*g* are formed in the nonoverlap regions 1322, 1342 of the respective terminal electrodes 1032, 1034.

The through holes 1019*a*, 1019*d* and notches 1019*b*, 1019*c* are formed in a peel prevention region included in the nonoverlap region 1342 of the terminal electrode 1034. The through holes 1019*a*, 1019*d* are formed in the first portion 1034*a* of the terminal electrode 1034 and near the side from which the second portion 1034*b* extends. The through holes 1019*a*, 1019*d* are formed each at respective positions outside the second portion 1034*b*. The notches 1019*b*, 1019*c* are formed in the first portion 1034*a* of the terminal electrode 1034, along the sides adjoining the side from which the second portion 1034*b* extends, and from the side opposite to the side from which the second portion 1034*b* extends.

The through holes 1019*f*, 1019*g* and the notches 1019*e*, 1019*h* are formed in a peel prevention region included in the nonoverlap region 1322 of the terminal electrode 1032. The through holes 1019*f*, 1019*g* are formed in the first portion 1032*a* of the terminal electrode 1032 and near the side from which the second portion 1032*b* extends. The through holes 1019*f*, 1019*g* are formed each at respective positions outside the second portion 1032*b*. The notches 1019*e*, 1019*h* are formed in the first portion 1032*a* of the terminal electrode 1032, along the sides adjoining the side from which the second portion 1032*b* extends, and from the side opposite to the side from which the second portion 1032*b* extends.

In the viewing direction of the plan view in (a) of FIG. 11, each set of the through holes 1019*a*, 1019*d* and notches 1019*e*, 1019*h*, and the notches 1019*b*, 1019*c* and through holes 1019*f*, 1019*g* are formed at corresponding positions.

The element body 1010*b* is formed so as to be smaller than the mutually overlapping portions of the terminal electrode 1032 and the terminal electrode 1034. Therefore, the nonoverlap regions 1322, 1342 are formed around the element body 1010*b* so that they do not overlap with the element body 1010*b*, while the terminal electrode 1032 and the terminal electrode 1034 overlap each other. The element body 1010*b* is compressed under pressure and heat against the pair of terminal electrodes 1032, 1034.

Each of the protecting films 1036 is located so as to cover a portion of the element body 1010*b* not compressed against the terminal electrodes 1032, 1034. There are four faces where the element body 1010*b* is not compressed against the terminal electrodes 1032, 1034, and the protecting films 1036 are arranged along the four respective faces.

The protecting films 1036 include anchor protecting films 1036*a*, 1036*b*, 1036*c*, 1036*d*, 1036*e*, 1036*f*, 1036*g*, 1036*h*. The anchor protecting films 1036*a*, 1036*b*, 1036*c*, 1036*d*, 1036*e*, 1036*f*, 1036*g*, 1036*h* are portions of the protecting films penetrating through the respective through holes 1019*a*, 1019*d*, 1019*e*, 1019*h* and notches 1019*b*, 1019*c*, 1019*f*, 1019*g* to the opposing surface of the terminal electrode 1032, 1034.

The anchor protecting films 1036*a*, 1036*d* 1036*e*, 1036*h* are formed so as to cover the through holes 1019*a*, 1019*d*, 1019*e*, 1019*h*, respectively. The anchor protecting films 1036*b*, 1036*c* 1036*f*, 1036*g* are formed so as to cover the notches 1019*b*, 1019*c*, 1019*f*, 1019*g*, respectively. Therefore, the protecting films 1036 are formed so that the terminal electrodes 1032, 1034 are pinched by the whole protecting films by virtue of anchor effects of the respective anchor protecting films 1036*a*, 1036*b* 1036*c*, 1036*d*, 1036*e*, 1036*f*, 1036*g*, 1036*h* through the through holes 1019*a*, 1019*d*, 1019*e*, 1019*h* and the notches 1019*b*, 1019*c*, 1019*f*, 1019*g*, whereby the terminal electrodes 1032, 1034 and the protecting films 1036 are fixed.

The compositions and others of the element body 1010*b* and the protecting films 1036 are much the same as those of the element body 1010 and the protecting films 1016 described previously, and thus the description thereof is omitted herein.

Figure 12:
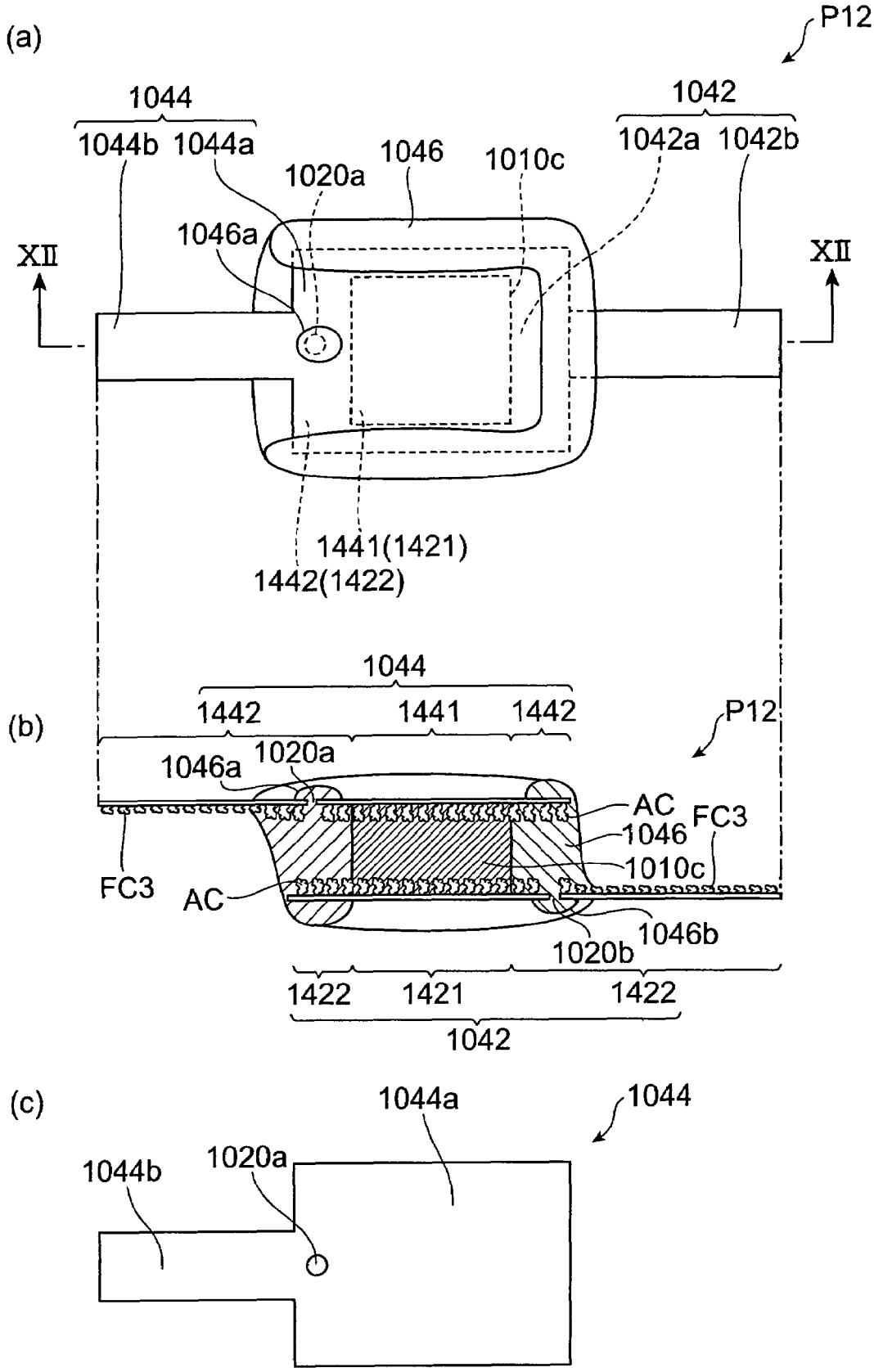
FIG. 12 is a drawing showing a third modification example of the PTC element in the third embodiment.

FIG. 12 shows a third modification example of the third embodiment. Part (a) of FIG. 12 is a plan view of PTC element P12 as the third modification example, part (b) of FIG. 12 a sectional view of the PTC element P12 near an edge thereof (along XII-XII in (a) of FIG. 12), and part (c) of FIG. 12 a plan view of terminal electrode 1044 being a constitutive element of the PTC element P12. The PTC element P12 comprises a pair of terminal electrodes 1042, 1044, an element body 1010*c*, and protecting films 1046.

The pair of terminal electrodes 1042, 1044 are formed in the thickness of about 0.1 mm and of Ni or Ni alloy. Each of the terminal electrodes 1042, 1044 has a first portion 1042*a*, 1044*a* and a second portion 1042*b*, 1044*b*. The second portion 1042*b*, 1044*b* is formed so as to extend from a nearly central region of one side of the first portion 1042*a*, 1044*a*. The second portion 1042*b*, 1044*b* is formed in a width smaller than that of the first portion 1042*a*, 1044*a*. The pair of terminal electrodes 1042, 1044 are arranged so that the first portions 1042*a*, 1044*a* are opposed to each other. Since the element body 1010*c* is disposed between the first portions 1042*a*, 1044*a* opposed to each other, the element body 1010*c* is sandwiched between the opposed surfaces of the respective terminal electrodes 1042, 1044. Therefore, each of the pair of terminal electrodes 1042, 1044 is composed of an overlap region 1421, 1441 overlapping with the element body 1010*c*, and a nonoverlap region 1422, 1442 not overlapping with the element body 1010*c*.

Through holes 1020*a*, 1020*b* are formed in the nonoverlap regions 1422, 1442 of the respective terminal electrodes 1042, 1044.

The through hole 1020*a* is formed in a peel prevention region included in the nonoverlap region 1442 of the terminal electrode 1044. The through hole 1020*a* is formed in the first portion 1044*a* of the terminal electrode 1044 and near an approximate center of the side from which the second portion 1044*b* extends.

The through hole 1020*b* is formed in a peel prevention region included in the nonoverlap region 1422 of the terminal electrode 1042. The through hole 1020*b* is formed in the first portion 1042*a* of the terminal electrode 1042 and near an approximate center of the side from which the second portion 1042*b* extends.

Therefore, the third modification example is an example in which each of the through holes 1020*a*, 1020*b* is formed only on the side from which the second portion 1042*b*, 1044*b* extends, in the nonoverlap region 1422, 1442.

The element body 1010*c* is formed so as to be smaller than the mutually overlapping portions of the terminal electrode 1042 and the terminal electrode 1044. Therefore, the nonoverlap regions 1422, 1442 are formed around the element body 1010*c* so that they do not overlap with the element body 1010*c*, while the terminal electrode 1042 and the terminal electrode 1044 overlap each other. The element body 1010*c* is compressed under pressure and heat against the pair of terminal electrodes 1042, 1044.

Each of the protecting films 1046 is located so as to cover a portion of the element body 1010*c* not compressed against the terminal electrodes 1042, 1044. There are four faces where the element body 1010*c* is not compressed against the terminal electrodes 1042, 1044, and the protecting films 1046 are arranged along the four respective faces.

The protecting film 1046 includes anchor protecting films 1046*a*, 1046*b*. The anchor protecting films 1046*a*, 1046*b* are portions of the protecting films penetrating through the respective through holes 1020*a*, 1020*b* to the opposing surface of the terminal electrode 1042, 1044.

The anchor protecting films 1046*a*, 1046*b* are formed so as to cover the through holes 1020*a*, 1020*b*, respectively. Therefore, the protecting films 1046 are formed so that the terminal electrodes 1042, 1044 are pinched by the whole protecting films by virtue of anchor effects of the respective anchor protecting films 1046*a*, 1046*b* through the through holes 1020*a*, 1020*b*, whereby the terminal electrodes 1042, 1044 and the protecting films 1046 are fixed.

The compositions and others of the element body 1010*c* and the protecting films 1046 are much the same as those of the element body 1010 and the protecting films 1016 described previously, and thus the description thereof is omitted herein.

Figure 13:
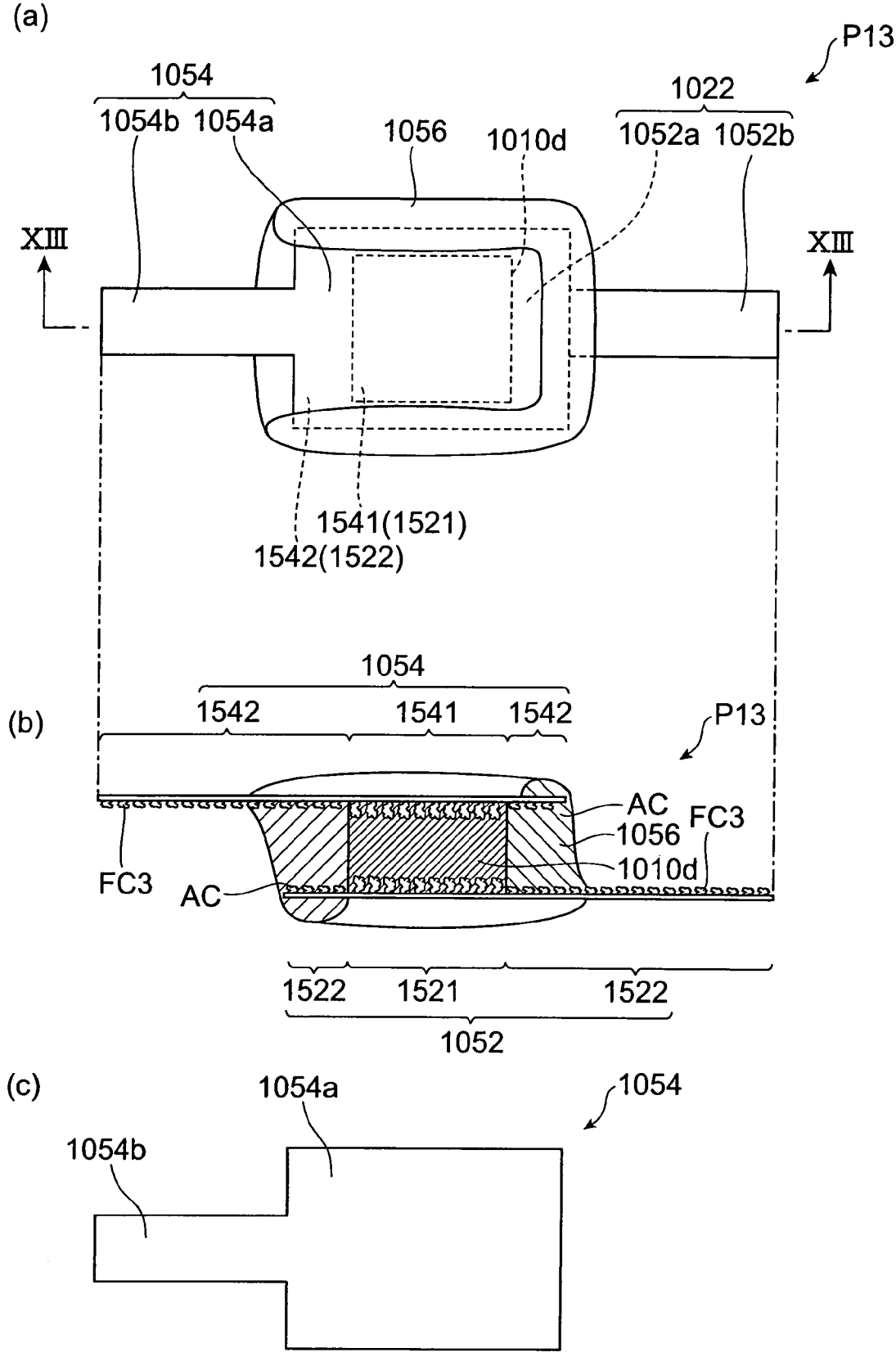
FIG. 13 is a drawing showing a PTC element as a comparative example in the third embodiment.

Subsequently, let us describe the peel prevention effect of the protecting films 1016, 1026, 1036, 1046 in the PTC elements P9, P10, P11, and P12 of the third embodiment. A PTC element P13 shown in FIG. 13 is used as a comparative object. Part (a) of FIG. 13 is a plan view of the PTC element P13 as a comparative object, part (b) of FIG. 13 a sectional view of the PTC element P13 near the center thereof (along XIII-XIII in (a) of FIG. 13), and part (c) of FIG. 13 a plan view of terminal electrode 1054 as a constitutive element of the PTC element P13.

The PTC element P13 comprises a pair of terminal electrodes 1052, 1054, an element body 1010*d*, and protecting films 1056.

The pair of terminal electrodes 1052, 1054 are formed in the thickness of about 0.1 mm and of Ni or Ni alloy. Each of the terminal electrodes 1052, 1054 has a first portion 1052*a*, 1054*a* and a second portion 1052*b*, 1054*b*. The second portion 1052*b*, 1054*b* is formed so as to extend from a nearly central region of one side of the first portion 1052*a*, 1054*a*. The second portion 1052*b*, 1054*b* is formed in a width smaller than that of the first portion 1052*a*, 1054*a*. The pair of terminal electrodes 1052, 1054 are arranged so that the first portions 1052*a*, 1054*a* are opposed to each other. Since the element body 1010*d* is disposed between the first portions 1052*a*, 1054*a* opposed to each other, the element body 1010*d* is sandwiched between the opposed surfaces of the respective terminal electrodes 1052, 1054. Therefore, each of the pair of terminal electrodes 1052, 1054 is composed of an overlap region 1521, 1541 overlapping with the element body 1010*d*, and a nonoverlap region 1522, 1542 not overlapping with the element body 1010*d*.

The element body 1010*d* is formed so as to be smaller than the mutually overlapping portions of the terminal electrode 1052 and the terminal electrode 1054. Therefore, the nonoverlap regions 1522, 1542 are formed around the element body 1010*d* so that they do not overlap with the element body 1010*d*, while the terminal electrode 1052 and the terminal electrode 1054 overlap each other. The element body 1010*d* is compressed under pressure and heat against the pair of terminal electrodes 1052, 1054.

Each of the protecting films 1056 is located so as to cover a portion of the element body 1010*d* not compressed against the terminal electrodes 1052, 1054. There are four faces where the element body 1010*d* is not compressed against the terminal electrodes 1052, 1054, and the protecting films 1056 are arranged along the four respective faces.

The compositions and others of the element body 1010*d* and the protecting films 1056 are much the same as those of the element body 1010 and the protecting films 1016 described previously, and thus the description thereof is omitted herein.

A plurality of anchor projections AC and flattened projections FC3 are formed on the surfaces of the terminal electrodes 1052, 1054 between which the element body 1010*d* is interposed.

The anchor projections AC are formed only in the overlap regions 1521, 1541. The flattened projections FC3 are formed in the nonoverlap regions 1522, 1542.

Figure 14:
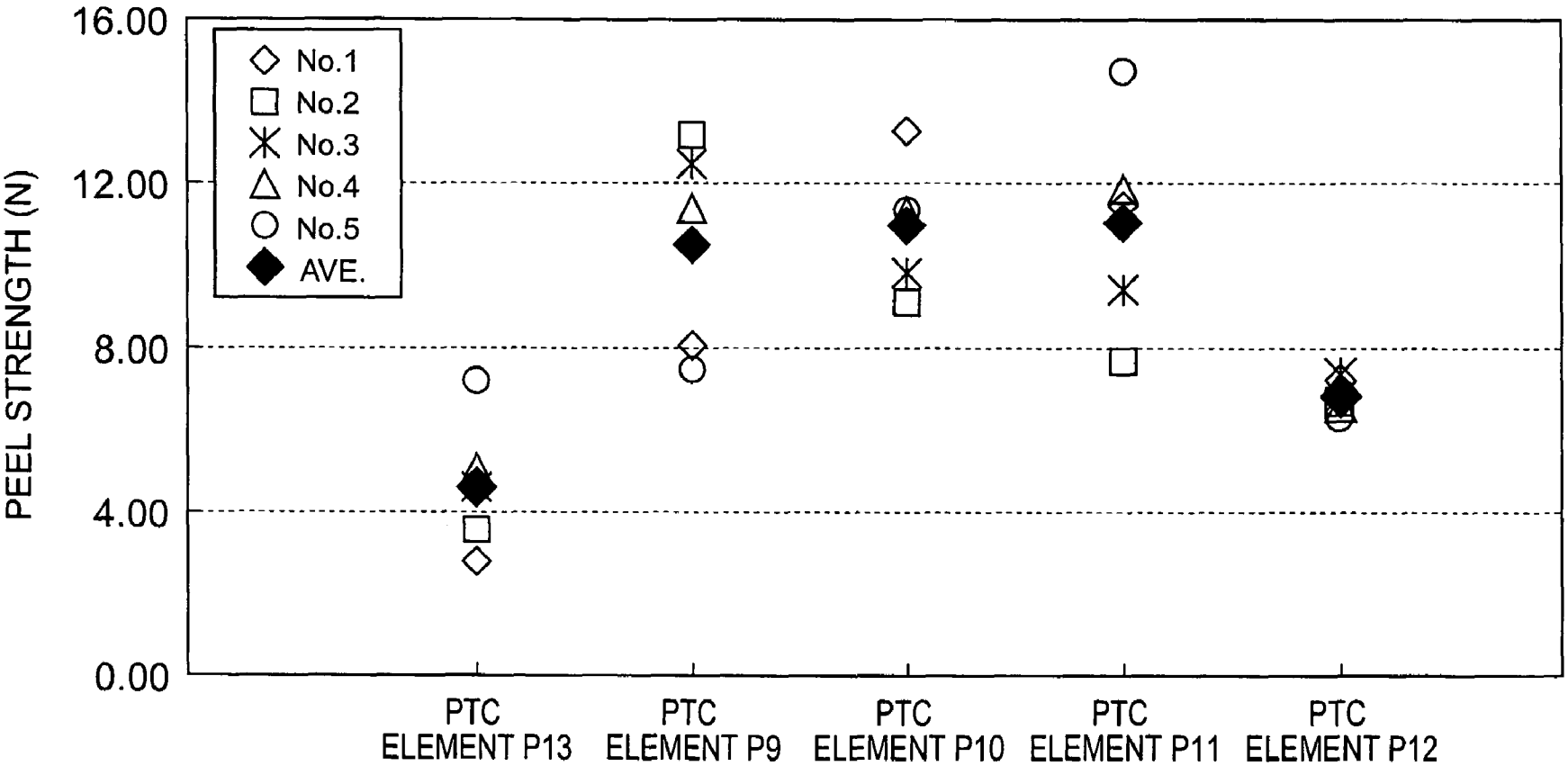
FIG. 14 is a drawing showing the results of comparison between the PTC elements of the third embodiment and the PTC element of the comparative example

FIG. 14 shows the results of peel tests of terminal electrodes with the above-described PTC elements P9, P10, P11, P12, and P13. FIG. 14 indicates the peel strengths of the protecting films in the tests of perpendicularly peeling the terminal electrode from the element body for each of the PTC elements P9, P10, P11, P12, and P13.

As shown in FIG. 14, the PTC elements P9, P10, P11, and P12 according to the third embodiment demonstrate the peel strengths higher than those of the PTC element P13. Specifically, the peel strengths of five samples of PTC element P13 are 2.75 N-7.16 N, and an average thereof is 4.63 N. The peel strengths of five samples of PTC element P9 are 7.45 N-13.14 N, and an average thereof is 10.49 N. The peel strengths of five samples of PTC element P10 are 9.08 N-13.28 N, and an average thereof is 10.97 N. The peel strengths of five samples of PTC element P11 are 7.65 N-14.71 N, and an average thereof is 11.02 N. The peel strengths of five samples of PTC element P12 are 6.54 N-7.45 N.

This is because the peel strength is increased when the anchor projections AC are embedded in the protecting films 1016, 1026, 1036, 1046. The peel strength is further increased because the protecting films 1016, 1026, 1036, 1046 are sandwiched between the terminal electrode 1012, 1022, 1032, 1042 and the terminal electrode 1014, 1024, 1034, 1044. The peel strength is further increased because the protecting films 1016, 1026, 1036, 1046 penetrate through the through holes 1017*a*-1017*d*, through the notches 1018*a*-1018*h*, through the through holes 1019*a*-1019*d* and the notches 1019*e*-1019*h*, or through the through holes 1020*a*, 1020*b* to the opposing surfaces of the terminal electrodes 1012, 1014, 1022, 1024, 1032, 1034, 1042, 1044.

Subsequently, let us describe a production method of the above-described PTC elements P9, P10, P11, P12. The production method of the PTC elements P9, P10, P11, P12 comprises an element body preparation step, a terminal preparation step, a flattening step, a thermal compression step, and a protecting film forming step. Since the PTC elements P9, P10, P11, and P12 are formed basically by the same production method except for formation of the through holes 1017*a*-1017*d*, the notches 1018*a*-1018*h*, the through holes 1019*a*-1019*d* and notches 1019*e*-1019*h*, or the through holes 1020*a* and 1020*b*, the production method of the PTC element P9 will be described as a representative example.

The element body preparation step is to make and prepare an element body material intended for the element body 1010. First, Ni powder to become an electroconductive filler is mixed with polyethylene as a matrix resin to form a block. This block is pressed into a disk shape and cut to obtain an element body material.

The subsequent terminal preparation step is to make and prepare metal plates to become the terminal electrodes 1012, 1014. The anchor projections AC are formed on the surfaces of the terminal electrodes 1012, 1014 between which the element body 1010 is interposed. The anchor projections AC are the aforementioned nodules formed in a succession. The terminal electrodes prepared are the terminal electrode 1012 in which the through holes 1016*c*, 1016*d* are formed, and the terminal electrode 1014 in which the through holes 1016*a*, 1016*d* are formed.

The flattening step is to crush and flatten the anchor projections AC in the required regions as described above, to form the flattened projections FC3. A press movement amount in this case is 10-35 μm and more preferably 10-15 μm.

The flattened projections FC3 are formed in contact with each other so as to be substantially flattened, as described above. In terms of the thicknesses of the terminal electrodes, the average thickness in the regions where the flattened projections FC3 are formed is smaller than the average thickness in the regions where the anchor projections AC are formed. The average thicknesses can be determined by punching out a piece of a predetermined area as a specimen and obtaining the mass and specific gravity thereof.

For example, in the case of the PTC element P9 of the third embodiment, the preferred thicknesses after the flattening step are as follows: the thicknesses in the overlap regions 1121, 1141 and in the nonoverlap regions 1122, 1142 including the peel prevention regions (the regions where the anchor projections AC are formed) are 60-140 μm; the thicknesses in the nonoverlap regions 1122, 1142 except for the peel prevention regions (the regions where the anchor projections AC are formed) are 50-120 μm. In this case, the average height of the anchor projections AC is 5-40 μm. The thicknesses after the flattening step are more preferably determined as follows: the thicknesses in the overlap regions 1121, 1141 and in the nonoverlap regions 1122, 1142 including the peel prevention regions are 95-100 μm; and the thicknesses in the nonoverlap regions 1122, 1142 except for the peel prevention regions are 80-90 μm. In this case, the average height of the anchor projections AC is 5-20 μm.

When the thicknesses in the overlap regions 1121, 1141 and in the nonoverlap regions 1122, 1142 including the peel prevention regions are larger than 140 μm, the terminal electrodes 1012, 1014 become too thick. For this reason, thermal compression becomes insufficient between the element body 1010 and the terminal electrodes 1012, 1014, and connection strength becomes weaker between the element body 1010 and the terminal electrode 1012, 1014. Therefore, the thicknesses in the nonoverlap regions 1122, 1142 except for the peel prevention regions are preferably set to not more than 120 μm in view of the flattening.

When the thicknesses in the nonoverlap regions 1122, 1142 except for the peel prevention regions are smaller than 50 μm, the strength of the terminal electrodes 1012, 1014 per se becomes reduced. This makes handling difficult during production steps and after completion of a product, e.g., the element will be bent in the nonoverlap regions 1122, 1142 except for the peel prevention regions. Therefore, the thicknesses in the overlap regions 1121, 1141 are preferably not less than 60 μm in view of the flattening of the nonoverlap regions 1122, 1142.

When the average height of the anchor projections AC is smaller than 5 μm, the anchor effect is not fully exhibited between the element body 1010 and the terminal electrodes 1012, 1014, so as to lower the connection strength between the element body 1010 and the terminal electrodes 1012, 1014. When the average height of the anchor projections AC is larger than 40 μm, the strength of the anchor projections AC per se becomes lowered, and the anchor projections AC will fall off the terminal electrodes 1012, 1014 during the thermal compression with the element body 1010.

The thermal compression step is to interpose the element body material (element body) between the overlap regions 1121, 1141 in the pair of respective terminal electrodes 1012, 1014 and to perform thermal compression to fix the pair of terminal electrodes 1012, 1014 and the element body 1010.

The protecting film forming step is to form the protecting films 1016. The protecting films 1016 are formed by letting an epoxy resin react with a thiol-type curing agent to form a cured layer and dispersing a filler of a material with a lower oxygen permeability than that of the cured layer, in the cured layer.

In the formation of the protecting films 1016, the anchor protecting films 1016*a*-1016*d* are formed so that the protecting films 1016 penetrate through the respective through holes 1017*a*-1017*d* to the opposite side of the terminal electrode 1012, 1014 (through the through holes and the notches in the other modification examples in the same manner as in the case of the through holes). Even if air remains in the portions between the terminal electrodes 1012, 1014 during the formation of the protecting films 1016, it can be discharged through the through holes 1017*a*-1017*d*.

Since in the third embodiment the nonoverlap regions 1122, 1142 are substantially flattened except for the peel prevention regions of the terminal electrodes 1012, 1014, the bond strength can be enhanced in joining to other terminals. Since the peel prevention regions are formed in the nonoverlap regions 1122, 1142 adjoining the element body and the protecting films 1016 are formed in the anchor shape through the through holes 1017*a*-1017*d* to fix the terminal electrodes 1012, 1014, peeling of the protecting films 1016 covering the element body 1010 is prevented.

From the invention thus described, it will be obvious that the invention may be varied in many ways. Such variations are not to be regarded as a departure from the spirit and scope of the invention, and all such modifications as would be obvious to one skilled in the art are intended for inclusion within the scope of the following claims.

What is claimed is:

1. A PTC element comprising:

an element body in which an electroconductive filler is dispersed in a crystalline polymer;

a pair of lead terminals compressed with the element body in between; and a protecting film covering a portion of the element body not compressed against the pair of lead terminals;

wherein each of the pair of lead terminals has an overlap region overlapping with the element body, and a nonoverlap region not overlapping with the element body, wherein an anchor projection embedded in the element body is formed in the overlap region of each of the pair of lead terminals, wherein a peel prevention region for preventing peeling of the protecting film is formed in a region adjoining the element body in the nonoverlap region, and wherein the anchor projection is formed as crushed, in a region except for at least the peel prevention region in the nonoverlap region.

2. The PTC element according to claim 1, wherein the peel prevention region is formed in a region where the pair of lead terminals overlap each other.

3. The PTC element according to claim 1, wherein the anchor projection embedded in the protecting film is formed in the peel prevention region.

4. The PTC element according to claim 1, wherein the peel prevention region is a roughened region a surface of which is roughened.

5. The PTC element according to claim 4, wherein the surface of the roughened region is roughened by etching.

6. The PTC element according to claim 1, wherein at least one of a through hole and a notch is formed in the peel prevention region, and wherein the protecting film is formed through the at least one of the through hole and the notch to an opposing surface of the lead terminal.

7. The PTC element according to claim 6, wherein the at least one of the through hole and the notch is formed in a region where the pair of lead terminals overlap each other.

8. The PTC element according to claim 7, wherein the at least one of the through hole and the notch is formed in a region where the nonoverlap regions on both sides of the overlap region overlap each other.

9. A PTC element comprising:

an element body in which an electroconductive filler is dispersed in a crystalline polymer;

a pair of lead terminals compressed with the element body in between; and a protecting film covering a portion of the element body not compressed against the pair of lead terminals;

wherein each of the pair of lead terminals has an overlap region overlapping with the element body, and a non-overlap region not overlapping with the element body, wherein an anchor projection embedded in the element body is formed in the overlap region of each of the pair of lead terminals, wherein a roughened region is formed in a region adjoining the element body in the nonoverlap region, and wherein the anchor projection is formed as crushed, in a region except for at least the roughened region in the nonoverlap region.

10. The PTC element according to claim 9, wherein the roughened region is formed in a region where the pair of lead terminals overlap each other.

11. The PTC element according to claim 10, wherein the roughened region is formed as roughened by etching.

12. A PTC element comprising:

an element body in which an electroconductive filler is dispersed in a crystalline polymer;

a pair of lead terminals compressed with the element body in between; and a protecting film covering a portion of the element body not compressed against the pair of lead terminals;

wherein each of the pair of lead terminals has an overlap region overlapping with the element body, and a non-overlap region not overlapping with the element body, wherein an anchor projection embedded in the element body is formed in the overlap region of each of the pair of lead terminals, wherein a region adjoining the element body in the non-overlap region has a peel prevention region in which at least one of a through hole and a notch is formed, wherein the protecting film is formed through the at least one of the through hole and the notch to an opposing surface of the lead terminal, and wherein the anchor projection is crushed in a region except for at least the peel prevention region in the nonoverlap region.

13. The PTC element according to claim 12, wherein the at least one of the through hole and the notch is formed in a region where the pair of lead terminals overlap each other.

14. The PTC element according to claim 13, wherein the at least one of the through hole and the notch is formed in a region where the nonoverlap regions on both sides of the overlap region overlap each other.

* * * * *